US008866802B2

(12) United States Patent
Yamauchi

(10) Patent No.: US 8,866,802 B2
(45) Date of Patent: Oct. 21, 2014

(54) PIXEL CIRCUIT AND DISPLAY DEVICE

(75) Inventor: Yoshimitsu Yamauchi, Osaka (JP)
(73) Assignee: Sharp Kabushiki Kaisha, Osaka (JP)

( * ) Notice: Subject to any disclaimer, the term of this patent is extended or adjusted under 35 U.S.C. 154(b) by 351 days.

(21) Appl. No.: 13/513,915
(22) PCT Filed: Nov. 19, 2010
(86) PCT No.: PCT/JP2010/070672
§ 371 (c)(1), (2), (4) Date: Jun. 29, 2012
(87) PCT Pub. No.: WO2011/070903
PCT Pub. Date: Jun. 16, 2011
(65) Prior Publication Data
US 2012/0268446 A1 Oct. 25, 2012
(30) Foreign Application Priority Data
Dec. 10, 2009 (JP) ..... 2009-280398
(51) Int. Cl.
*G09G 5/00* (2006.01)
*G09G 3/36* (2006.01)
(52) U.S. Cl.
CPC ..... *G09G 3/3659* (2013.01); *G09G 2300/0852* (2013.01); *G09G 2300/0876* (2013.01)
USPC ..... 345/205; 345/90; 345/92
(58) Field of Classification Search
CPC . G09G 3/3648; G09G 3/3655; G09G 3/3659; G09G 2300/0417; G09G 2300/0809; G09G 2300/0814; G09G 2300/0819; G09G 2300/0823; G09G 2300/0852; G09G 2300/0876; G09G 2300/088; G09G 2300/0885; G09G 2300/089; G09G 2300/0895; G09G 2320/0247
USPC ..... 345/87, 90, 92, 94, 95, 98, 99, 204, 345/205, 206, 208, 211, 214, 215
See application file for complete search history.

(56) References Cited

U.S. PATENT DOCUMENTS 5,729,308 A * 3/1998 Yamazaki et al. ..... 349/39
6,064,362 A 5/2000 Brownlow et al.
(Continued)

FOREIGN PATENT DOCUMENTS

JP 5-142573 A 6/1993
JP 10-62817 A 3/1998
(Continued)

OTHER PUBLICATIONS

Official Communication issued in International Patent Application No. PCT/JP2010/070672, mailed on Feb. 15, 2011.

*Primary Examiner* — Tom Sheng
(74) *Attorney, Agent, or Firm* — Keating & Bennett, LLP

(57) ABSTRACT

A display device which realizes a multi-gradation constant display with low power consumption is provided. A pixel circuit 2 includes an internal node N1 holding a pixel data voltage applied to a display element part 21, a first switch circuit 22 transferring the pixel data voltage supplied from a data signal line SL to the internal node N1 through a series circuit of first and second transistor elements T1 and T2, a second switch circuit 23 including a third transistor element T3 connecting a middle node N2, at which the first and second transistor elements T1 and T2 are connected, with a voltage supply line VSL, and a control circuit 24 including a series circuit of a fourth transistor element T4 and a first capacitive element C1, holding the pixel data voltage held in the internal node N1 at one end of the first capacitive element C1 through the fourth transistor element T4, and controlling on/off of the third transistor element T3 by a boost voltage applied to the other end of the first capacitive element C1.

18 Claims, 16 Drawing Sheets

(56) References Cited

U.S. PATENT DOCUMENTS

| | | | | |
|---|---|---|---|---|
| 6,297,518 | B1 * | 10/2001 | Zhang | 257/59 |
| 6,417,896 | B1 * | 7/2002 | Yamazaki et al. | 349/39 |
| 6,566,684 | B1 * | 5/2003 | Suzawa | 257/59 |
| 6,914,642 | B2 * | 7/2005 | Yamazaki et al. | 349/39 |
| 8,339,531 | B2 * | 12/2012 | Yamauchi | 349/41 |
| 2009/0086116 | A1 | 4/2009 | Pak | |
| 2012/0154365 | A1 * | 6/2012 | Yamauchi | 345/211 |
| 2012/0154369 | A1 * | 6/2012 | Yamauchi | 345/212 |
| 2012/0212476 | A1 * | 8/2012 | Yamauchi | 345/212 |
| 2012/0218247 | A1 * | 8/2012 | Yamauchi | 345/211 |
| 2012/0218252 | A1 * | 8/2012 | Yamauchi | 345/212 |

FOREIGN PATENT DOCUMENTS

| | | | |
|---|---|---|---|
| JP | 2001-306038 | A | 11/2001 |
| JP | 2002-297100 | A | 10/2002 |
| JP | 2009-86620 | A | 4/2009 |

* cited by examiner

PIXEL CIRCUIT AND DISPLAY DEVICE

CROSS-REFERENCE TO RELATED APPLICATIONS

This application is a National Phase filing under 35 U.S.C. §371 of International Application No. PCT/JP2010/070672 filed on Nov. 19, 2010, and which claims priority to Japanese Patent Application No. 2009-280398 filed on Dec. 10, 2009.

TECHNICAL FIELD

The present invention relates to a pixel circuit and a display device provided with the pixel circuit, and more particularly to an active matrix type liquid crystal display device.

BACKGROUND ART

FIG. 13 shows an equivalent circuit of a pixel circuit of a typical active matrix type liquid crystal display device. In addition, FIG. 14 shows a circuit arrangement example of the active matrix type liquid crystal display device having m×n pixels. As shown in FIG. 14, a switch element including a thin film transistor (TFT) is provided at each of intersecting points of m source lines (data signal lines) and n scanning lines (scanning signal lines), and as shown in FIG. 13, a liquid crystal element LC and a retentive capacity Cs are connected in parallel through the TFT. The liquid crystal element LC has a laminated structure in which a liquid crystal layer is provided between a pixel electrode and an opposite electrode (common electrode). In addition, FIG. 14 only shows, in a simplified manner, the TFT and the pixel electrode (black rectangular part) in the pixel circuit. The retentive capacity Cs has one end connected to the pixel electrode, and another end connected to a capacity line LCs, and stabilizes a voltage of pixel data held in the pixel electrode. The retentive capacity Cs has effects of preventing a fluctuation of a voltage of the pixel data held in the pixel electrode due to a leak current of the TFT, a fluctuation of electric capacity of the liquid crystal element LC between a black display and a white display due to dielectric constant anisotropy of liquid crystal molecules, and a voltage fluctuation generated due to parasitic capacity between the pixel electrode and a surrounding wiring. By sequentially controlling a voltage of the scanning line, the TFT connected to the scanning line is turned on, and the voltage of the pixel data supplied to the source line is written in the corresponding pixel electrode with respect to each scanning line.

In a normal display by way of a full-color display, even when display contents are still images, the same display contents are repeatedly written in the same pixel with respect to each frame, with the polarity of the voltage applied to the liquid crystal element LC being reversed every time, so that the voltage of the pixel data held in the pixel electrode is updated, the voltage fluctuation of the pixel data is suppressed to a minimum, and a high-quality display of the still image is maintained.

Power consumption to drive the liquid crystal display device is mainly dominated by power consumption to drive a source line by a source driver, and roughly expressed by a relational expression shown in the following formula 1. In the formula 1, P represents power consumption, f represents a refreshing rate (the number of times of refreshing actions for one frame per unit time), C represents load capacity driven by the source driver, V represents a drive voltage of the source driver, n represents the number of the scanning lines, and m represents the number of the source lines. It is to be noted that the refreshing action mean an action to clear a fluctuation generated in the voltage (absolute value) applied to the liquid crystal element LC and corresponding to the pixel data by rewriting the pixel data, and to return the voltage to the original voltage state corresponding to the pixel data.

$$P \propto f \cdot C \cdot V^2 \cdot n \cdot m \qquad \text{Formula 1}$$

Meanwhile, in the case where a still image is constantly displayed, since the display contents are still images, it is not always necessary to update the voltage of the pixel data with respect to each frame. Therefore, in order to further reduce the power consumption of the liquid crystal display device, a refreshing frequency is reduced at the time of this constant display. However, when the refreshing frequency is reduced, the pixel data voltage held in the pixel electrode fluctuates due to a leak current of the TFT. In addition, since an average potential is also reduced for each frame period, this voltage fluctuation leads to a fluctuation of display brightness (transmittance of the liquid crystal) in each pixel, which is recognized as a flicker. In addition, this may cause reduction in display quality such that sufficient contrast cannot be obtained.

Here, as a method for solving a problem of reduction in display quality due to the reduction in the refreshing frequency at the time of the constant display of the still image, for example, configurations are disclosed in the following patent documents 1 and 2. According to the configurations disclosed in the patent documents 1 and 2, the switch element of the pixel circuit shown in FIG. 13 is constituted by a series circuit including two TFTs (transistors T1 and t2), and its middle node N2 is driven so as to have the same potential as that of a pixel electrode N1 with a unity gain buffer amplifier 50, to prevent a voltage from being applied between a source and a drain of the TFT (T2) arranged on the side of the pixel electrode, so that a leak current of this TFT is considerably suppressed, and the problem of reduction in display quality can be solved (refer to FIGS. 15 and 16).

This is a method for a solution provided based on the fact that the leak current of the TFT considerably increases in association with an increase of a bias voltage between the source and the drain. As shown in FIGS. 15 and 16, according to the configurations described in the patent documents 1 and 2, as for the TFT (T1) connected to a source line SL, the bias voltage between the source and the drain increases and the leak current of the TFT could increase, but since the leak current is compensated by the buffer amplifier 50, it does not affect a pixel data voltage held in the pixel electrode N1. Thus, when the buffer amplifier 50 is provided, the problem of the reduction in display quality due to the reduction of the refreshing frequency can be solved, and power consumption can be reduced due to the reduction of the refreshing frequency. In addition, the configurations described in the patent documents 1 and 2 can be applied to two or more different voltage states as the pixel data voltages held in the pixel electrode, so that a multi-gradation constant display can be implemented with high display quality and low power consumption.

PRIOR ART DOCUMENT

Patent Document

Patent document 1: Japanese Unexamined Patent Publication No. 5-142573

Patent document 2: Japanese Unexamined Patent Publication No. 10-62817

DISCLOSURE OF THE INVENTION

Problems to be Solved by the Invention

However, with the spread of digital contents (such as advertisement, news, or digital book) in tandem with development of communication infrastructure, a still image is required to be constantly displayed in displaying images of the digital contents in mobile information terminals such as a mobile phone, or mobile internet device (MID). The mobile information terminal which displays the digital contents uses a liquid crystal display device which is low in power consumption, but hours to display the still image make up most of operation time of the terminal, so that the power consumption when still image is constantly displayed is required to be further reduced.

According to the configurations described in the patent documents 1 and 2, in the case where the unity gain buffer amplifier is ideal, a voltage is not applied between the source and the drain of the TFT arranged on the side of the pixel electrode in the switch element, so that the leak current of the TFT can be suppressed. However, in the case of the buffer amplifier provided with the two or four TFTs as described in the patent documents 1 and 2, a correct unity gain cannot be realized unless a threshold voltage of the TFT of the buffer amplifier is 0 V, so that the leak current of the TFT of the switch element is not sufficiently suppressed, and the pixel data voltage held in the pixel electrode may fluctuate. In addition, when the threshold voltage is close to 0 V, the power consumption increases contrary to the demand of low power consumption. Furthermore, in the case where the unity gain buffer amplifier is provided with an operation amplifier, its circuit size increases. This is not only contrary to the demand of low power consumption, but increases a rate of a circuit element region in the pixel circuit, and reduces an aperture ratio in a transmissive mode, so that brightness of the display image is reduced.

The present invention was made with view of the above problems, and an object thereof is to provide a pixel circuit and a display device which can support a multi-gradation display, and prevent reduction in display quality with low power consumption.

Means for Solving the Problem

In order to attain the above object, the present invention provides a pixel circuit including a display element part including a unit liquid crystal display element, an internal node constituting a part of the display element part, and holding a pixel data voltage applied to the display element part, a first switch circuit including a series circuit of a first and a second transistor elements, having one end connected to a data signal line and another end connected to the internal node, and transferring the pixel data voltage supplied from the data signal line to the internal node through the series circuit, a second switch circuit including a third transistor element, and having one end connected to a predetermined voltage supply line and another end connected to a middle node serving as a connection point between the first and the second transistor elements connected in series in the series circuit, and a control circuit including a series circuit of a fourth transistor element and a first capacitive element, holding the pixel data voltage held in the internal node at one end of the first capacitive element through the fourth transistor element, and controlling an on/off state of the third transistor element in the second switch circuit by a boost voltage applied to the other end of the first capacitive element, wherein each of the first to fourth transistor elements includes a first terminal, a second terminal, and a control terminal controlling a connection between the first and the second terminals, the control terminals of the first and second transistor elements are connected to a scanning signal line to turn on the first and second transistor elements at a time of an action to transfer the pixel data voltage to the internal node, the control terminal of the third transistor element, the second terminal of the fourth transistor element, and the one end of the first capacitive element are mutually connected to constitute an output node of the control circuit, the first terminal of the fourth transistor element is connected to the internal node, the control terminal of the fourth transistor element is connected to a first control line, and the other end of the first capacitive element is connected to a second control line for supplying the boost voltage.

Furthermore, according to the pixel circuit having the above characteristics, it is preferred that the first switch circuit consist of the series circuit of the first and the second transistor elements, the first terminal of the first transistor element is connected to the data signal line, the second terminal of the first transistor element and the first terminal of the second transistor element are connected to the middle node, and the second terminal of the second transistor element is connected to the internal node, and in addition, it is preferred that the second switch circuit consist of the third transistor element, the first terminal of the third transistor element is connected to the voltage supply line, and the second terminal of the third transistor element is connected to the middle node.

Furthermore, according to the pixel circuit having the above characteristics, it is preferred to include a second capacitive element having one end connected to the internal node and the other end connected to a third control line or the voltage supply line.

Further, in order to achieve the above object, the present invention provides, as first characteristics, a display device including a pixel circuit array having a plurality of the pixel circuits of the above characteristics arranged in a row direction and in a column direction, respectively, the pixel circuit array being provided in such a manner that the data signal line is provided for each of columns, the scanning signal line is provided for each of rows, the one ends of the first switch circuits in the pixel circuits arranged in the same column are connected to the common data signal line, the control terminals of the first and second transistor elements in the pixel circuits arranged in the same row are connected to the common scanning signal line, the one ends of the second switch circuits in the pixel circuits arranged in the same row or the same column are connected to the common voltage supply line, the control terminals of the fourth transistor elements in the pixel circuits arranged in the same row or the same column are connected to the common first control line, and the other ends of the first capacitive elements in the pixel circuits arranged in the same row or the same column are connected to the common second control line, the display device comprising:

a data signal line drive circuit driving the data signal lines separately, a scanning signal line drive circuit driving the scanning signal lines separately, a voltage supply line drive circuit driving the voltage supply lines separately or commonly, and a control line drive circuit driving the first control lines separately or commonly and driving the second control lines separately or commonly.

Furthermore, according to the display device of the first characteristics, it is preferred that the one ends of the second switch circuits in the pixel circuits arranged in the same row are connected to the common voltage supply line, the control terminals of the fourth transistor elements in the pixel circuits arranged in the same row are connected to the common first control line, and the other ends of the first capacitive elements in the pixel circuits arranged in the same row are connected to the common second control line.

Furthermore, according to the display device of the first characteristics, as second characteristics, at a time of a writing action to write pixel data having two or more gradations in the pixel circuits arranged in one selected row separately, the scanning signal line drive circuit applies a predetermined selected row voltage to the scanning signal line of the selected row to turn on the first and second transistor elements arranged in the selected row to activate the first switch circuit, and applies a predetermined unselected row voltage to the scanning signal line of the row except for the selected row to turn off the first and second transistor elements arranged in the row except for the selected row to inactivate the first switch circuit, and the data signal line drive circuit applies a pixel data voltage corresponding to the pixel data to be written in the pixel circuit in each column of the selected row, to each of the data signal lines separately.

Furthermore, according to the display device of the second characteristics, as third characteristics, at the time of the writing action, the voltage supply line drive circuit applies a first control voltage not lower than a maximum voltage of the pixel data voltage held in the internal node, to the voltage supply line connected to the pixel circuits arranged in the selected row, and the control line drive circuit applies a first switch voltage to the first control line connected to the pixel circuits arranged in the selected row, and applies a first boost voltage to the second control line connected to the pixel circuits arranged in the selected row.

Furthermore, according to the display device of the third characteristics, it is preferred that at the time of the writing action, the voltage supply line drive circuit apply the first control voltage to the voltage supply line connected to the pixel circuits arranged in the row except for the selected row, and the control line drive circuit apply the first switch voltage to the first control line connected to the pixel circuits arranged in the row except for the selected row, and apply the first boost voltage to the second control line connected to the pixel circuits arranged in the row except for the selected row.

Furthermore, according to the display device of the third characteristics, it is preferred that the first switch voltage is high enough to turn on the fourth transistor element and equalize potentials of the internal node and the output node.

Furthermore, according to the display device having one of the first to the third characteristics, as fourth characteristics, at a time of a voltage maintaining control action performed, after a writing action to write pixel data having two or more gradations in the pixel circuits arranged in one selected row separately is completed with respect to each row or all rows of the pixel circuit array, to maintain a voltage of the middle node of the pixel circuit in which the writing action is completed, at the pixel data voltage held in the internal node, the scanning signal line drive circuit applies the unselected row voltage to the scanning signal line of one or more control target rows in which the writing action is completed, to turn off the first and second transistor elements in the pixel circuits arranged in the control target row, the voltage supply line drive circuit applies a first control voltage not lower than a maximum voltage of the pixel data voltage held in the internal nodes, to the voltage supply line connected to the pixel circuits arranged in the control target row, and, under the condition that a first switch voltage is applied to the first control line connected to the pixel circuits arranged in the control target row to turn on the fourth transistor elements, and the internal node and the output node are at the same potential, the control line drive circuit applies a second switch voltage thereto to turn off the fourth transistor element to electrically separate the internal node and the output node, changes a voltage of the second control line connected to the pixel circuits arranged in the control target row from a first boost voltage to a second boost voltage, and boosts a voltage of the output node to a second control voltage provided by adding a threshold voltage of the third transistor element to the pixel data voltage held in the internal node, using capacitive coupling through the first capacitive element.

According to the display device of the fourth characteristics, it is still more preferred that at the time of the voltage maintaining control action, the control line drive circuit repeats a series of actions including an action to change the voltage of the second control line connected to the pixel circuits arranged in the control target row from the first boost voltage to the second boost voltage, and after a lapse of a predetermined time, return the voltage of the second control line from the second boost voltage to the first boost voltage, an action thereafter to return a voltage of the first control line connected to the pixel circuits arranged in the control target row from the second switch voltage to the first switch voltage to equalize the potentials of the internal node and the output node, and thereafter apply the second switch voltage to the first control line again to electrically separate the internal node and the output node, and an action to change the voltage of the second control line connected to the pixel circuits arranged in the control target row from the first boost voltage to the second boost voltage again.

According to the display device of the fourth characteristics, it is further preferred that the first operation by the control line drive circuit to apply the first switch voltage to the first control line connected to the pixel circuits arranged in the control target row to equalize the potentials of the internal node and the output node is performed at the time of the writing action performed for the pixel circuits arranged in the control target row.

According to the display device of the fourth characteristics, it is further preferred that in the case where the control terminals of the fourth transistor elements of the pixel circuits arranged in the same row are connected to the common first control line, and the other ends of the first capacitive elements of the pixel circuits arranged in the same row are connected to the common second control line, every time the writing action is completed with respect to each row of the pixel circuit array, the voltage maintaining control action is started for the pixel circuits in the control target row in which the writing action is completed without waiting for the completion of the writing action for all of the rows.

According to the display device of the fourth characteristics, it is further preferred that at the time of the voltage maintaining control action performed after the writing action for all of the rows of the pixel circuit array, a first reset voltage not higher than a minimum voltage of the pixel data voltage held in the internal node is applied to all of the data signal lines.

According to the display device of the fourth characteristics, it is further preferred that at the time of the voltage maintaining control action, at least one resetting action is performed in such a manner that the control line drive circuit applies the second switch voltage to the first control line connected to the pixel circuits arranged in the control target row to electrically separate the internal node and the output node, the voltage supply line drive circuit applies a second reset voltage not higher than a minimum voltage of the pixel data voltage held in the internal node, to the voltage supply line connected to the pixel circuits arranged in the control target row, and the control line drive circuit changes the voltage of the second control line connected to the pixel circuits arranged in the control target row from the first boost voltage to a third boost voltage, applies a third control voltage higher than the threshold voltage of the third transistor element to the output node by the capacitive coupling through the first capacitive element to turn on the second switch circuit, and resets the voltage state of the middle node to the second reset voltage. However, it is to be noted that in the case where the pixel circuit includes a second capacitive element having one end connected to the internal node, and the other end connected to the voltage supply line, the resetting action is not performed.

Effect of the Invention

According to the pixel circuit and the display device of the above characteristics, in each display mode of the normal display and constant display, the pixel data can be written from the data signal line to the internal node with the first switch circuit. That is, in the pixel circuit, the on/off of the first and the second transistor elements in the first switch circuit is externally controlled through the scanning signal line, and the voltage supplied to the data signal line is externally controlled, so that the voltage held in the internal node of the pixel circuit can be controlled. Therefore, the refreshing action of the voltage held in the internal node can be performed by the writing action of the pixel data performed by the external control as a matter of course. In this case, according to the pixel circuit having the above characteristics, the second switch circuit is not used in the writing action, and the control circuit is also not used for an original purpose, so that it is functionally the same as the pixel circuit shown in FIG. 13. In the normal display mode, high-gradation pixel data of full-color display can be written with the color display using the three pixel circuits, by finely controlling the voltage supplied to the data signal line. In addition, in the constant display mode also, the multi-gradation pixel data of the color display can be written by controlling the voltage supplied to the data signal line with the multi-gradation.

Note that the pixel circuit of the present invention constitutes a sub pixel corresponding to each color of three primary colors (RGB) serving as a minimum display unit in the case of the color display. Therefore, in the case of the color display, the pixel data is gradation data of each of the three primary colors.

Furthermore, since the pixel circuit having the above characteristics is provided with the second switch circuit and the control circuit, the potential of the middle node in the first switch circuit can be maintained at the same potential as that of the internal node, in the pixel circuit after the completion of the writing action by the following manner, and a voltage is not applied between the first terminal and the second terminal (that is, between the source and the drain) of the transistor element (second transistor element) positioned between the middle node and the internal node, so that a leak current is prevented from flowing in this transistor element. Therefore, the pixel data voltage held in the internal node can be prevented from fluctuating due to the leak current of the transistor element in the pixel circuit, and the reduction in display quality can be suppressed.

According to the pixel circuit having the above characteristics, since the on/off of the fourth transistor element is controlled through the first control line, the pixel data voltage held in the internal node can be sampled and held in the output node of the control circuit to which the control terminal of the third transistor element, the second terminal of the fourth transistor element, and the one end of the first capacitive element are mutually connected, and the potential of the output node can be set to be higher than the potential of the internal node by the threshold voltage of the third transistor element in the second switch circuit by adjusting the boost voltage inputted to the other end of the first capacitive element through the second control line with the fourth transistor element turned off so as not to affect the pixel data voltage. Here, when the voltage (first control voltage) not lower than the maximum voltage of the pixel data voltage is applied from the voltage supply line, the voltage provided by subtracting the threshold voltage of the third transistor element from the voltage of the output node, that is, the same voltage as the pixel data voltage is supplied from the voltage supply line to the middle node regardless of the voltage value of the pixel data voltage held in the internal node. Therefore, according to the pixel circuit having the above characteristics, the leak current of the second transistor element can be considerably suppressed, the pixel data voltage can be prevented from fluctuating, and reduction in display quality can be suppressed by controlling the control circuit through the first control line and the second control line, and applying the predetermined voltage to the voltage supply line. In addition, according to the second switch circuit and the control circuit, unlike the conventional configuration provided with the buffer amplifier, the direct current path does not exist, so that the above operation can be implemented with extremely low power consumption.

MODE FOR CARRYING OUT THE INVENTION

Hereinafter, a description will be given of each embodiment of a pixel circuit and a display device of the present invention with reference to the drawings.

First Embodiment

In a first embodiment, a description will be given of configurations of the display device of the present invention (hereinafter, simply referred to as the "display device") and the pixel circuit of the present invention (hereinafter, simply referred to as the "pixel circuit").

Figure 1:
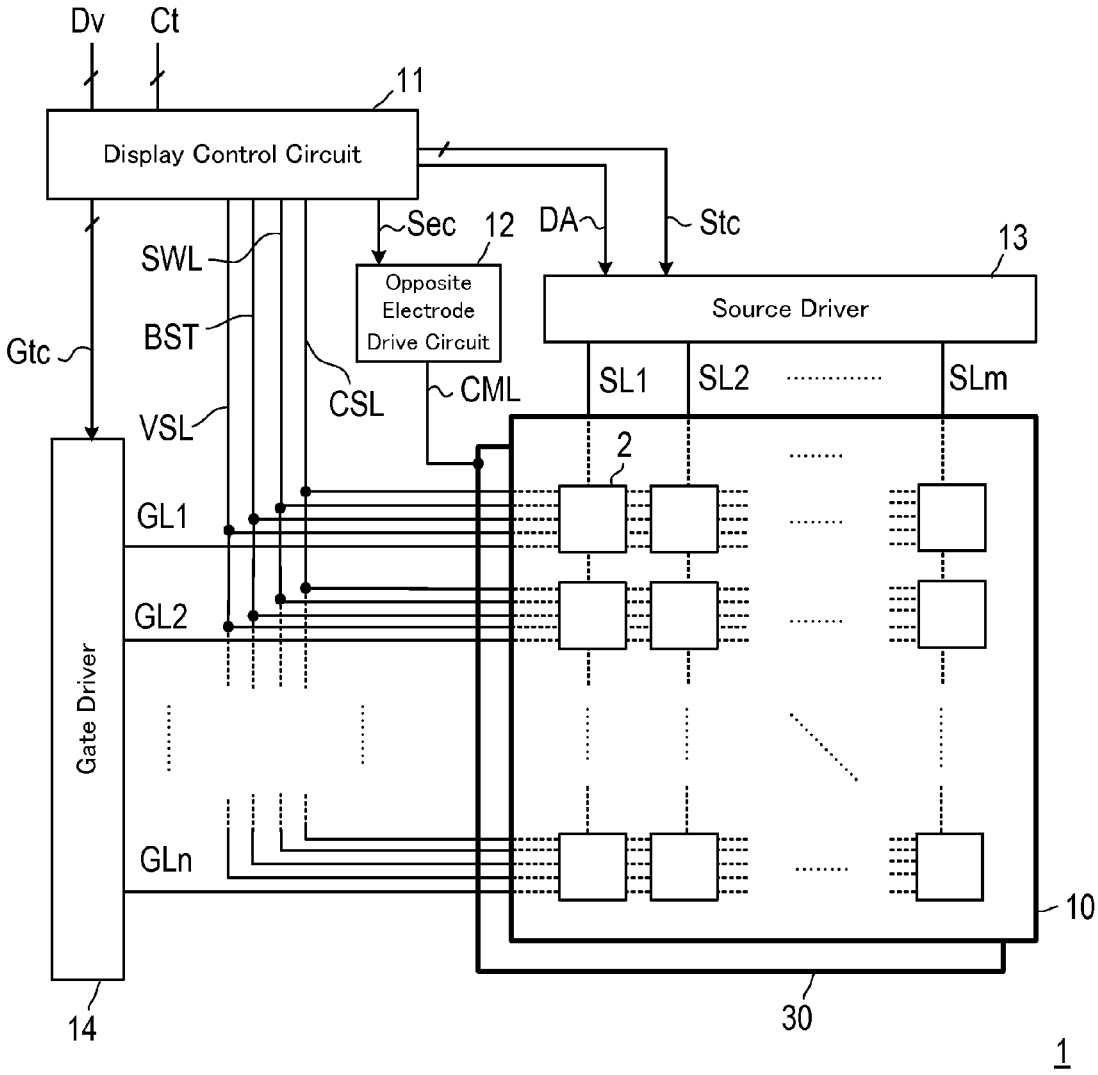
FIG. 1 is a block diagram showing one example of a schematic configuration of a display device of the present invention.

FIG. 1 shows a schematic configuration of a display device 1. The display device 1 includes an active matrix substrate 10, an opposite electrode 30, a display control circuit 11, an opposite electrode drive circuit 12, a source driver 13, a gate driver 14, and various signal lines which will be described below. On the active matrix substrate 10, a plurality of pixel circuits 2 are arranged in a row direction and a column direction, respectively, and a pixel circuit array is formed. It is to be noted that the pixel circuit 2 be shown as a block in FIG. 1 so as to prevent the drawing from becoming complicated. Moreover, in FIG. 1, for descriptive purposes, the active matrix substrate 10 is shown above the opposite electrode 30 so as to make it clear that the various signal lines are formed on the active matrix substrate 10.

According to the present embodiment, the display device 1 can make a screen display in two display modes of a normal display mode and a constant display mode with the same pixel circuit 2. The normal display mode is a mode in which a moving image or a still image is displayed in full color and a transmissive liquid crystal display using a backlight is used. Meanwhile, in the constant display mode in the present embodiment, n gradations (n≥2, such as n=4) are displayed in each pixel circuit, and when the three adjacent pixel circuits 2 are allocated to each of three primary colors (R, G, B), 64 colors are displayed (in the case where n=4). In addition, in the constant display mode, the number of display colors can be increased by an area coverage modulation by further combining a plurality of sets of the three adjacent pixel circuits. Moreover, the constant display mode in the present embodiment can be used in the transmissive liquid crystal display and a reflective liquid crystal display.

In the following description, for descriptive purposes, a minimum display unit corresponding to the one pixel circuit 2 is referred to as the "pixel", and "pixel data" to be written in each pixel circuit is gradation data of each color, in a case of a color display with the three primary colors (R, G, B). In a case of a color display which includes brightness data of black and white, in addition to the primary colors, the brightness data is also included in the pixel data.

As will be described below, the display device 1 is characterized in that a "voltage maintaining control action" which will be described below can be performed in the constant display mode of the still image, and power consumption can be considerably reduced compared with the case where the conventional "refreshing action" is performed, and can be applied to a configuration in which the liquid crystal display is made only using the constant display mode without combining both of the normal display mode and the constant display mode, as a matter of course.

Figure 2:
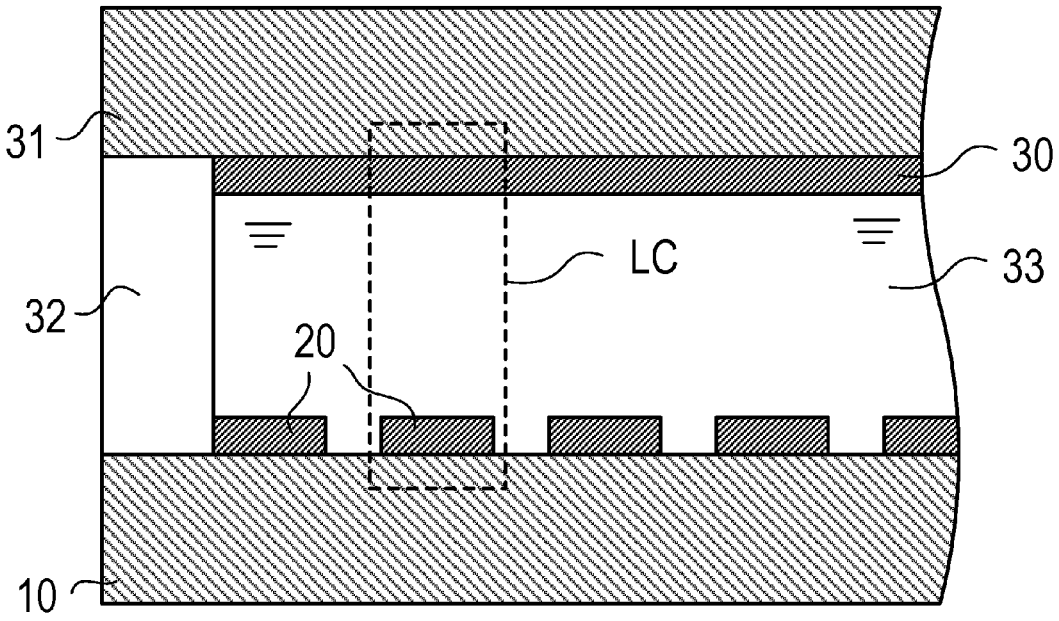
FIG. 2 is a partial cross-sectional schematic structure diagram of a liquid crystal display device.

FIG. 2 is a schematic cross-sectional structure view showing a relationship between the active matrix substrate 10 and the opposite electrode 30, and shows a structure of a display element part 21 (refer to FIG. 3) serving as a component of the pixel circuit 2. The active matrix substrate 10 is a light transmissive transparent substrate made of glass or plastic, for example. As shown in FIG. 1, the pixel circuits 2 each including the signal lines are formed on the active matrix substrate 10. In FIG. 2, a pixel electrode 20 is shown as a representative of the components of the pixel circuit 2. The pixel electrode 20 includes a light transmissive transparent conductive material such as ITO (indium tin oxide).

A light transmissive opposite substrate 31 is arranged so as to be opposed to the active matrix substrate 10, and a liquid crystal layer 33 is held in a gap between the substrates. A polarization plate (not shown) is attached to an outer surface of each of the substrates.

The liquid crystal layer 33 is sealed with a sealing material 32, in a surrounding area of both substrates. On the opposite substrate 31, the opposite electrode 30 made of the light transmissive transparent conductive material such as ITO is formed so as to be opposed to the pixel electrode 20. This opposite electrode 30 is formed as a single film so as to spread nearly all over the opposite substrate 31. Here, a unit liquid crystal display element LC (refer to FIG. 3) is formed by the one pixel electrode 20, the opposite electrode 30, and the liquid crystal layer 33 held therebetween.

It is to be noted that a backlight device (not shown) be arranged on a back surface side of the active matrix substrate 10, and can emit light in a direction from the active matrix substrate 10 toward the opposite substrate 31.

As shown in FIG. 1, the signal lines are formed on the active matrix substrate 10 in a horizontal direction and in a vertical direction. Thus, the pixel circuits 2 are formed, in the shape of a matrix, at intersecting points of m source lines (SL1, SL2, . . . , SLm) extending in the vertical direction (column direction), and n gate lines (GL1, GL2, . . . , GLn) extending in the horizontal direction (row direction), whereby a pixel circuit array is formed. Note that each of the numbers m and n is a natural number of two or more. A voltage corresponding to an image to be displayed is applied to the pixel electrode 20 formed in the pixel circuit 2 from the source driver 13 and the gate driver 14 through the source line SL and the gate line GL. It is to be noted that the source lines (SL1, SL2, . . . , SLm) be collectively referred to as the "source line SL", and the gate lines (GL1, GL2, . . . , GLn) be collectively referred to as the "gate line GL" for descriptive purposes.

Here, the source line SL corresponds to a "data signal line", and the gate line GL corresponds to a "scanning signal line". In addition, the source driver 13 corresponds to a "data signal line drive circuit", the gate driver 14 corresponds to a "scanning signal line drive circuit", and the display control circuit 11 partially corresponds to a "control line drive circuit" and a "voltage supply line drive circuit".

According to the present embodiment, a first control line SWL, a second control line BST, an auxiliary capacity line CSL (corresponding to a "third control line"), and a voltage supply line VSL are provided as the signal lines to drive the pixel circuit 2, in addition to the source line SL and the gate line GL described above. The auxiliary capacity line CSL is driven by the display control circuit 11, as one example.

According to the configuration shown in FIG. 1, each of the first control line SWL, the second control line BST, the auxiliary capacity line CSL, and the voltage supply line VSL is provided in each row so as to extend in a row direction, and wirings of each row are mutually connected and unified in a periphery part of the pixel circuit array, but as another configuration, the wirings in each row may be individually driven and a common voltage may be applied thereto according to an operation mode. In the case where the "voltage maintaining control action" which will be described below is collectively executed for the pixel circuits 2 in the pixel circuit array by the row, each of the first control line SWL, the second control line BST, and the voltage supply line VSL is provided in each row separately so as to extend in the row direction. In addition, in the case where the "voltage maintaining control action" is collectively executed for the all of the pixel circuits 2 in the pixel circuit array, or collectively executed by the column, any or all of the first control line SWL, the second control line BST, and the voltage supply line BSL may be provided in each column so as to extend in the column direction.

The display control circuit 11 controls the writing actions in the normal display mode and the constant display mode, and the voltage maintaining control action in the constant display mode as will be described below. At the time of the writing action, the display control circuit 11 receives a data signal Dv and a timing signal Ct representing an image to be displayed, from an external signal source, and generates signals for displaying the image on the display element part 21 in the pixel circuit array, based on the signals Dv and Ct, such as a digital image signal DA and a data side timing control signal Stc to be applied to the source driver 13, a scanning side timing control signal Gtc to be applied to the gate driver 14, an opposite voltage control signal Sec to be applied to the opposite electrode drive circuit 12, and signal voltages to be applied to the first control line SWL, the second control line BST, the auxiliary capacity line CSL, and the voltage supply line VSL. It is also preferable that a part or the whole of the display control circuit 11 is provided in the source driver 13 or the gate driver 14.

The source driver 13 is controlled by the display control circuit 11 so as to apply a source signal having a predetermined timing and a predetermined voltage value to the source line SL at the time of the writing action and the voltage maintaining control action. At the time of the writing action, the source driver 13 generates a voltage which corresponds to a pixel value for one display line represented by the digital signal DA, and is appropriate for a voltage level of an opposite voltage Vcom, as each of source signals Sc1, Sc2, . . . , Scm with respect to each horizontal period (also referred to as the "H period"), based on the digital image signal DA and the data side timing control signal Stc. The voltages are multi-gradation analog voltages (mutually dispersed voltage values) according to the normal display mode and the constant display mode. These source signals are applied to the corresponding source lines SL1, SL2, . . . , SLm, respectively. In addition, at the time of the voltage maintaining control action, the source driver 13 is controlled by the display control circuit 11 and applies the same voltage to each of the source lines SL connected to the target pixel circuit 2 (details will be described below).

The gate driver 14 is controlled by the display control circuit 11 and applies a gate signal having a predetermined timing and a predetermined voltage amplitude to each gate line GL at the time of the writing action and the voltage maintaining control action. At the time of the writing action, the gate driver 14 sequentially selects the gate lines GL1, GL2, . . . , GLn with respect to roughly each horizontal period, for each frame period of the digital image signal DA, in order to write the source signals Sc1, Sc2, . . . , Scm in the pixel circuits 2, based on the scanning side timing control signal Gtc. In addition, at the time of the voltage maintaining control action, the gate driver 14 is controlled by the display control circuit 11 and applies the same voltage to each gate line GL connected to the target pixel circuits 2 (details will be described below). Note that the gate driver 14 may be provided on the active matrix substrate 10 as in the case in the pixel circuit 2.

The opposite electrode drive circuit 12 applies the opposite voltage Vcom to the opposite electrode 30 through an opposite electrode wiring CML. According to the present embodiment, the opposite electrode drive circuit 12 alternately switches the opposite voltage Vcom between a predetermined high level (5 V) and a predetermined low level (0 V) and outputs it, in the normal display mode and the constant display mode. Thus, to drive the opposite electrode 30 while switching the opposite voltage Vcom between the high level and the low level is referred to as the "opposite AC driving". In addition, according to the "opposite AC driving" in the normal display mode, the opposite voltage Vcom is switched between the high level and the low level with respect to each horizontal period and each frame period. That is, in a certain frame period, a voltage polarity between the opposite electrode 30 and the pixel electrode 20 is changed between the two adjacent horizontal periods, and in the same horizontal period, the voltage polarity between the opposite electrode 30 and the pixel electrode 20 is changed between the two adjacent frame periods. It is to be noted that in the constant display mode, the same voltage level be maintained in one frame period, but the voltage polarity between the opposite electrode 30 and the pixel electrode 20 be changed between the two adjacent writing actions.

In the case where the voltage having the same polarity is continuously applied between the opposite electrode 30 and the pixel electrode 20, burn-in of the display screen (surface burn-in) occurs, so that a polarity reversing action is required. However, the employment of the "opposite AC driving" can reduce a voltage amplitude to be applied to the pixel electrode 20 in the polarity reversing action.

Figure 3:
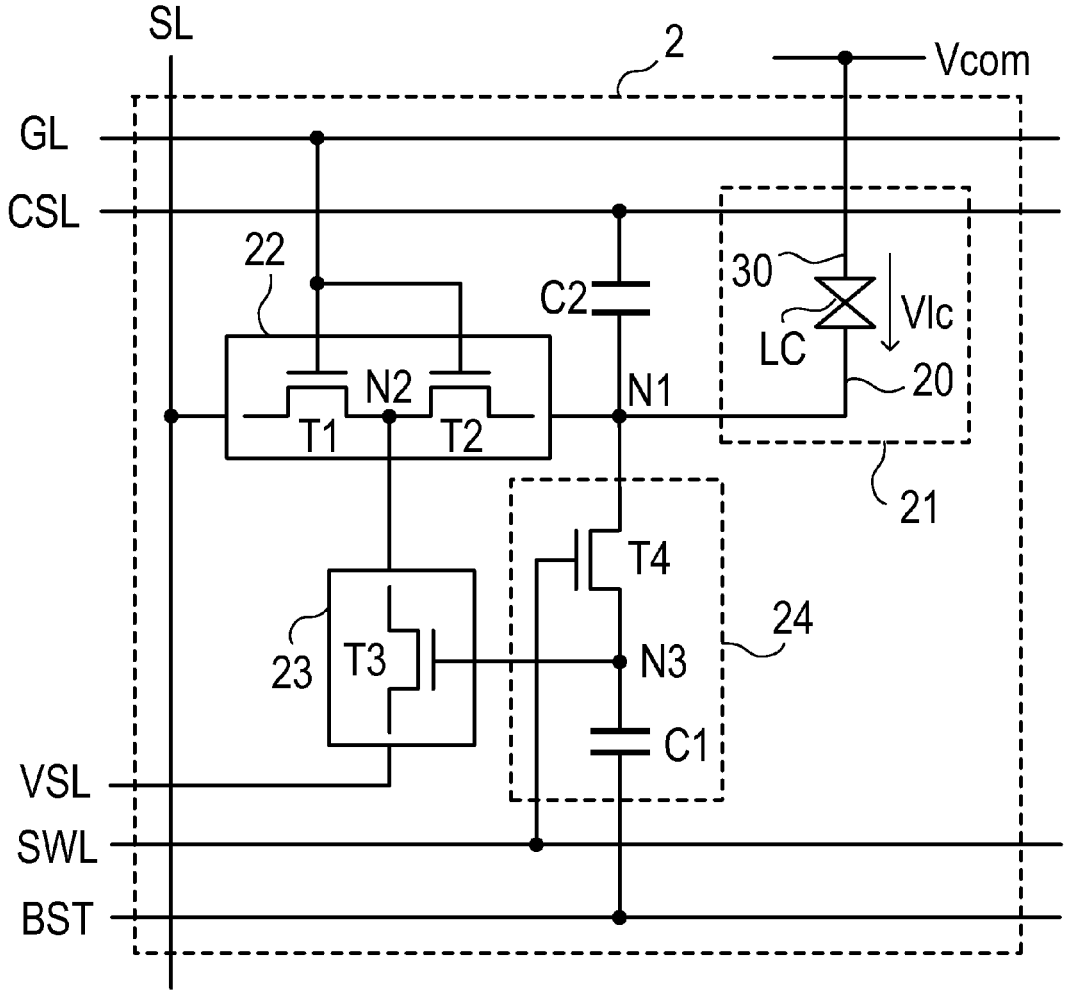
FIG. 3 is a circuit diagram showing a basic circuit configuration (first type) of a pixel circuit of the present invention.

Next, a configuration of the pixel circuit 2 will be described with reference to FIGS. 3 and 4. FIG. 3 shows a basic circuit configuration of the pixel circuit 2 of the present invention. The pixel circuit 2 includes the display element part 21 having the unit liquid crystal display element LC, an auxiliary capacitive element C2 (corresponding to a second capacitive element), a first switch circuit 22, a second switch circuit 23, and a control circuit 24. Note that the basic circuit configuration shown in FIG. 3 show a broader conceptual circuit configuration including a specific circuit configuration example (the simplest circuit configuration example including the auxiliary capacitive element C2) shown in FIG. 4. Since the unit liquid crystal display element LC has been already described with reference to FIG. 2, its description is omitted.

The pixel electrode 20 is connected to one ends of the first switch circuit 22 and the control circuit 24, whereby an internal node N1 is formed. The internal node N1 holds a voltage of the pixel data voltage supplied from the source line SL at the time of the writing action. The auxiliary capacitive element C2 has one end connected to the internal node N1, and the other end connected to the auxiliary capacity line CSL. The auxiliary capacitive element C2 is additionally provided so that the internal node N1 can stably hold the pixel data voltage. It is to be noted that the pixel data voltage be a pixel voltage V20 applied to the pixel electrode 20, and the pixel data voltage be referred to as the pixel voltage V20 occasionally.

The first switch circuit 22 has the other end connected to the source line SL, and includes a series circuit having at least a transistor T1 (corresponding to a first transistor element) and a transistor T2 (corresponding to a second transistor element), and control terminals of the transistor T1 and the transistor T2 are connected to the gate line GL. When at least the transistor T1 and the transistor T2 are off, the first switch circuit 22 is in an off state, and connection between the source line SL and the internal node N1 is cut. A connection point N2 at which the transistor T1 and the transistor T2 are connected in series is referred to as the "middle node N2". According to the circuit configuration example shown in FIG. 4, the first switch circuit 22 includes a series circuit only having the transistor T1 and the transistor T2, and a first terminal of the transistor T1 is connected to the source line SL, a second terminal of the transistor T1 is connected to a first terminal of the transistor T2 to form the middle node N2, and a second terminal of the transistor T2 is connected to the internal node N1.

The second switch circuit 23 includes a transistor T3 (corresponding to a third transistor element), and its one end is connected to the voltage supply line VSL, and the other end thereof is connected to the middle node N2. A control terminal of the transistor T3 is connected to an output node N3 of the control circuit, and an on/off state of the transistor T3 is controlled based on a voltage state of the output node N3. According to the circuit configuration example shown in FIG. 4, the second switch circuit 23 only includes the transistor T3, and the first terminal of the transistor T3 is connected to the voltage supply line VSL, and a second terminal thereof is connected to the middle node N2.

The control circuit 24 includes a series circuit having a transistor T4 (corresponding to a fourth transistor element), and a first capacitive element C1, and the first terminal of the transistor T4 is connected to the internal node N1, the second terminal of the transistor T4 is connected to one end of the first capacitive element C1, the control terminal of the transistor T4 is connected to the first control line SWL, and the other end of the first capacitive element C1 is connected to the second control line BST. The second terminal of the transistor T4 and one end of the first capacitive element C1 form the output node N3, and when the transistor T4 is on, the output node N3 has the same potential as that of the internal node N1, and a voltage level of the pixel voltage V20 held in the internal node N1 is sampled in the output node N3, and when the transistor T4 is turned off, the sampled voltage level of the pixel voltage V20 is held. When a predetermined boost voltage is applied to the second control line BST connected to the other end of the first capacitive element C1, the voltage level held in the output node N3 can be changed and adjusted by capacitive coupling through the first capacitive element C1, so that the on/off state of the transistor T3 of the second switch circuit 23 can be finely controlled by the adjusted voltage level.

Each of the four kinds of transistors T1 to T4 is a thin film transistor such as a polycrystalline silicon TFT or an amorphous silicon TFT which is formed on the active matrix substrate 10, and one of the first and second terminals corresponds to a drain electrode, the other thereof corresponds to a source electrode, and the control terminal corresponds to a gate electrode. In addition, each of the transistors T1 to T4 may be constituted by a single transistor, but in the case where suppression of a leak current generated in an off state is highly required, it may be configured such that the several transistors are connected in series and the control terminals are shared. In the following description about the operation of the pixel circuit 2, it is assumed that each of the transistors T1 to T4 is an N-channel type polycrystalline silicon TFT, and its threshold voltage is about 2 V.

Figure 4:
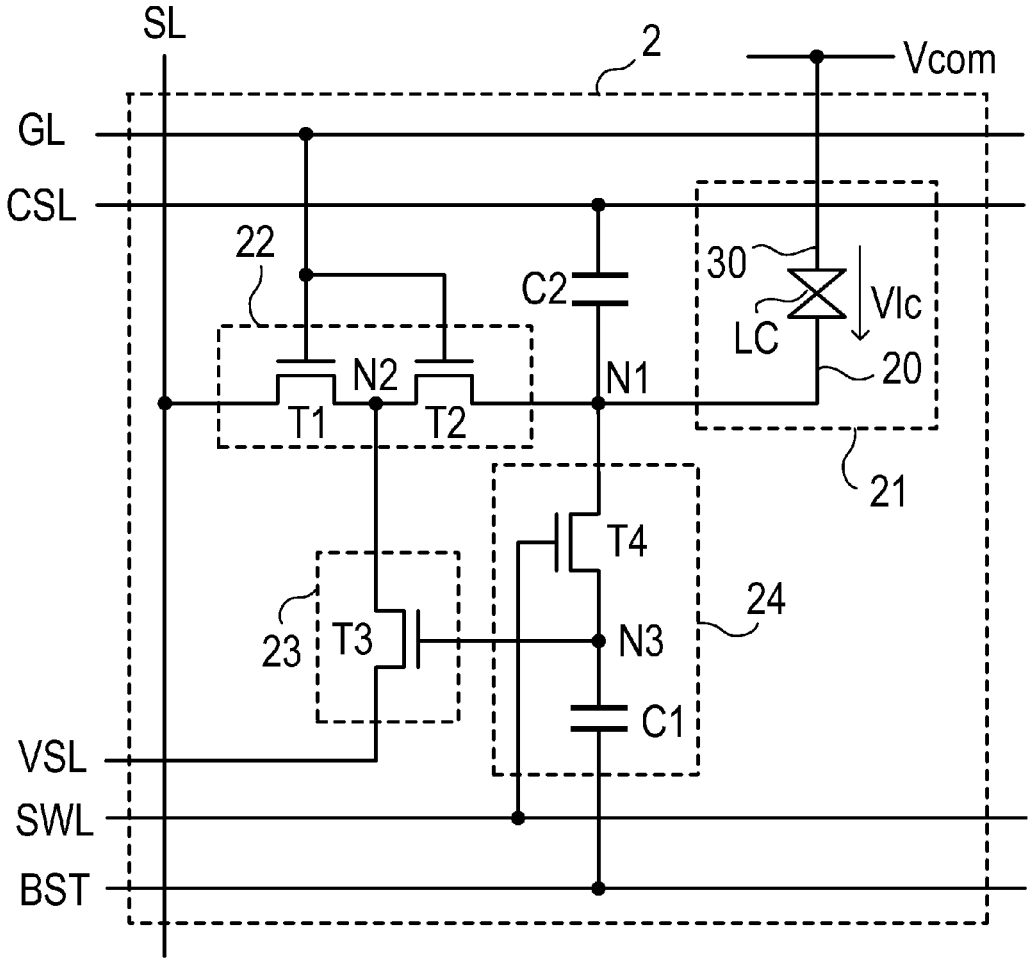
FIG. 4 is a circuit diagram showing one circuit configuration example (first type) of the pixel circuit of the present invention.
Figure 5:
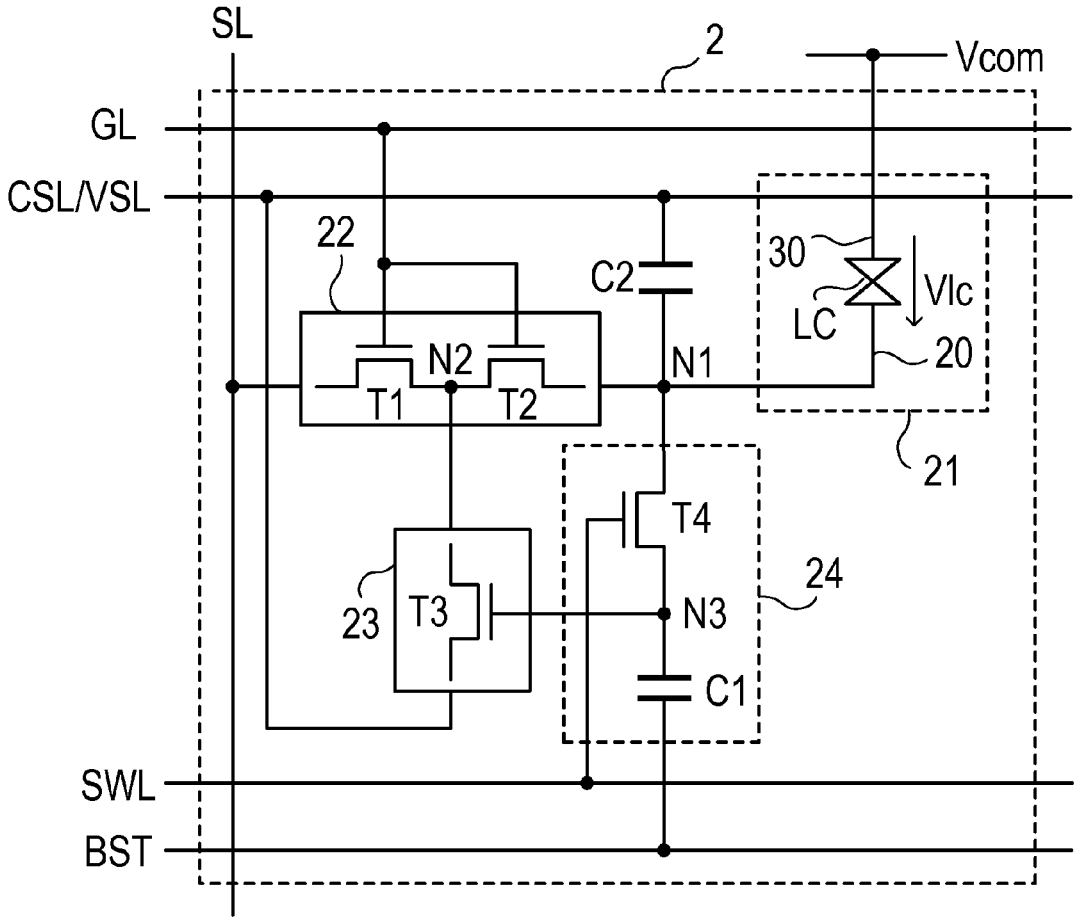
FIG. 5 is a circuit diagram showing a basic circuit configuration (second type) of a pixel circuit of the present invention.
Figure 6:
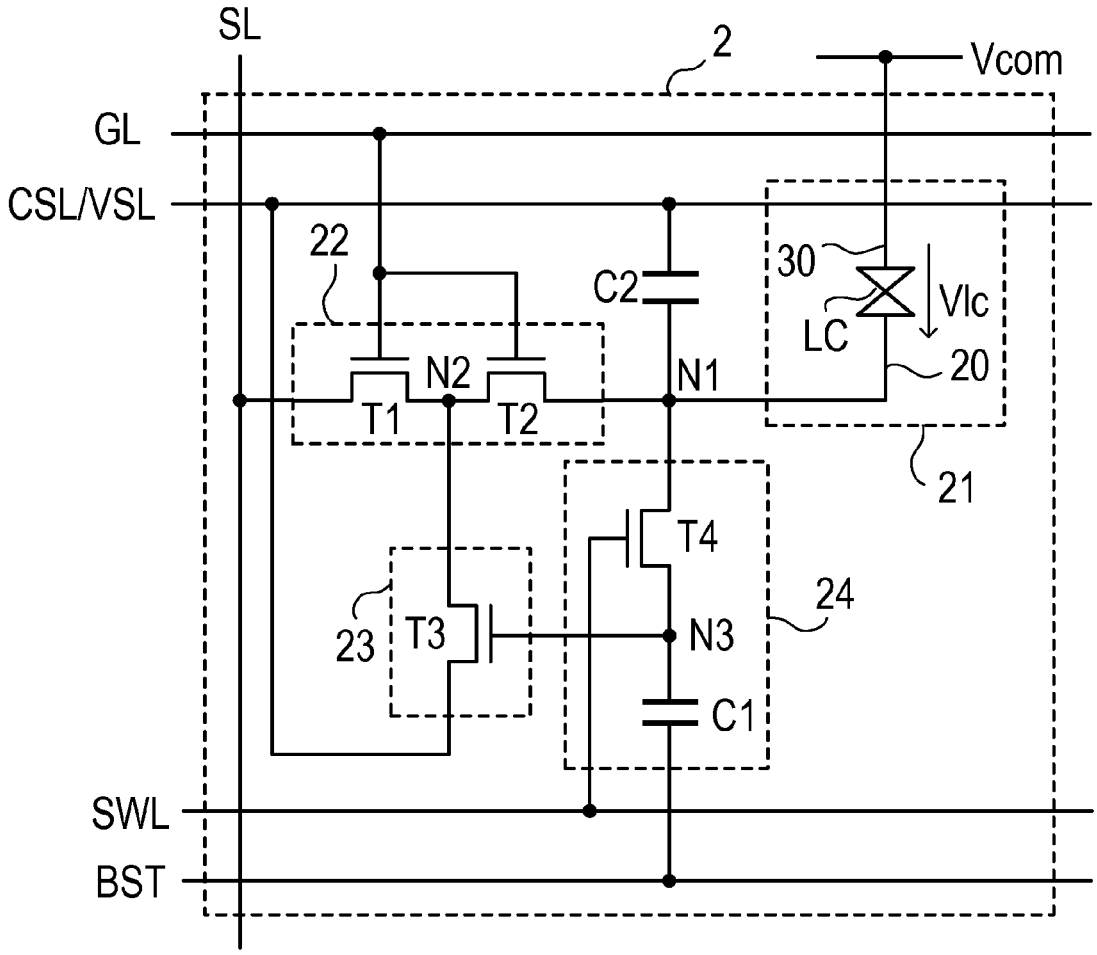
FIG. 6 is a circuit diagram showing one circuit configuration example (second type) of the pixel circuit of the present invention.

Furthermore, as shown in FIG. 5 or 6, the pixel circuit 2 may have another configuration in which the voltage supply line VSL and the auxiliary capacity line CSL are combined as a voltage supply line CSL/VSL, and the other end of the auxiliary capacitive element C2 and the one end of the second switch circuit 23 are connected to the same voltage supply line CSL/VSL, compared with the circuit configuration shown in FIG. 3 or 4. In this case, in the display device 1 shown in FIG. 1, the voltage supply line VSL and the auxiliary capacity line CSL are combined to be the voltage supply line CSL/VSL. Furthermore, according to the circuit configuration shown in FIG. 5 or 6, at the time of the writing action and the voltage maintaining control action, there is a restriction such that the voltage application conditions of the auxiliary capacity line CSL and the voltage supply line VSL in the circuit configuration shown in FIG. 3 or 4 need to be the same. Hereinafter, for descriptive purposes, the circuit configurations shown in FIGS. 3 and 4 are referred to as a first type, and the circuit configurations shown in FIGS. 5 and 6 are referred to as a second type, to distinguish them.

As for the circuit configuration shown in FIG. 4 or 6, it is assumed that there are variations of the pixel circuit 2 such as a configuration in which another transistor element is added and connected in series to the series circuit of the transistor T1 and the transistor T2 of the first switch circuit 22, a configuration in which the gate line GL connected to the control terminals of the transistor T1 and the transistor T2 is divided into two lines, and on/off of the transistor T1 and the transistor T2 are separately controlled, and a configuration in which another transistor element is added and connected in series to the transistor T3 of the second switch circuit 23. However, as long as, at the time of the writing action and the voltage maintaining control action, the on/off of the added transistor element is controlled based on the on/off of the first switch circuit 22 and the second switch circuit 23, the actions of the first and second switch circuits 22 and 23 at the time of the writing action and the voltage maintaining control action in the circuit configuration shown in FIG. 4 or 6 are substantially the same as those of the above variations. Thus, hereinafter, the writing action and the voltage maintaining control action for the pixel circuit 2 will be described in the following second to sixth embodiments, based on the circuit configuration shown in FIG. 4 or 6. However, according to the second type circuit configuration shown in FIG. 6, as described above, there is a restriction that the voltage application conditions of the auxiliary capacity line CSL and the voltage supply line VSL need to be the same, so that the writing action and the voltage maintaining control action may be partially restricted, and this restriction in action will be described in each embodiment.

Second Embodiment

In a second embodiment, a description will be given of the writing action in the constant display mode with reference to the drawings. However, in the second embodiment, first, a description will be given of a case where the voltage maintaining control action which will be described below is not executed in parallel with the writing action performed for one frame, that is, a case where only the writing action is executed.

According to the writing action in the constant display mode, pixel data for one frame is divided with respect to each display line in the horizontal direction (row direction), a pixel data voltage corresponding to each pixel data for the one display line (for example, in the case of the four gradations, one of four gradation voltages dispersed in a range of the voltages from a low level (0 V) to a high level (5 V)) is applied to the source line SL in each column, and a selected row voltage 8 V is applied to the gate line GL in the selected display line (selected row) to turn on the first switch circuit 22 of each pixel circuit 2 in the selected row, so that the voltage of the source line SL in each column is transferred to the internal node N1 of each pixel circuit 2 in the selected row. In addition, an unselected row voltage −5 V is applied to the gate line GL (unselected row) except for the selected display line to turn off the first switch circuit 22 of each pixel circuit 2 in the unselected row. Note that the timing control of the voltage applied to each signal line in the writing action as will be described below is performed by the display control circuit 11 shown in FIG. 1, and individual voltage application is performed by the display control circuit 11, the opposite electrode drive circuit 12, the source driver 13, and the gate driver 14. Furthermore, the gradation voltage is determined based on transmittance characteristics of the liquid crystal layer 33 with respect to the liquid crystal voltage Vlc applied to between the pixel electrode 20 and the opposite electrode 30 of the unit liquid crystal display element LC. In addition, the liquid crystal voltage Vlc is given as a difference voltage (V20−Vcom) between the opposite voltage Vcom of the opposite electrode 30 and the pixel voltage V20 held in the pixel electrode 20.

Figure 7:
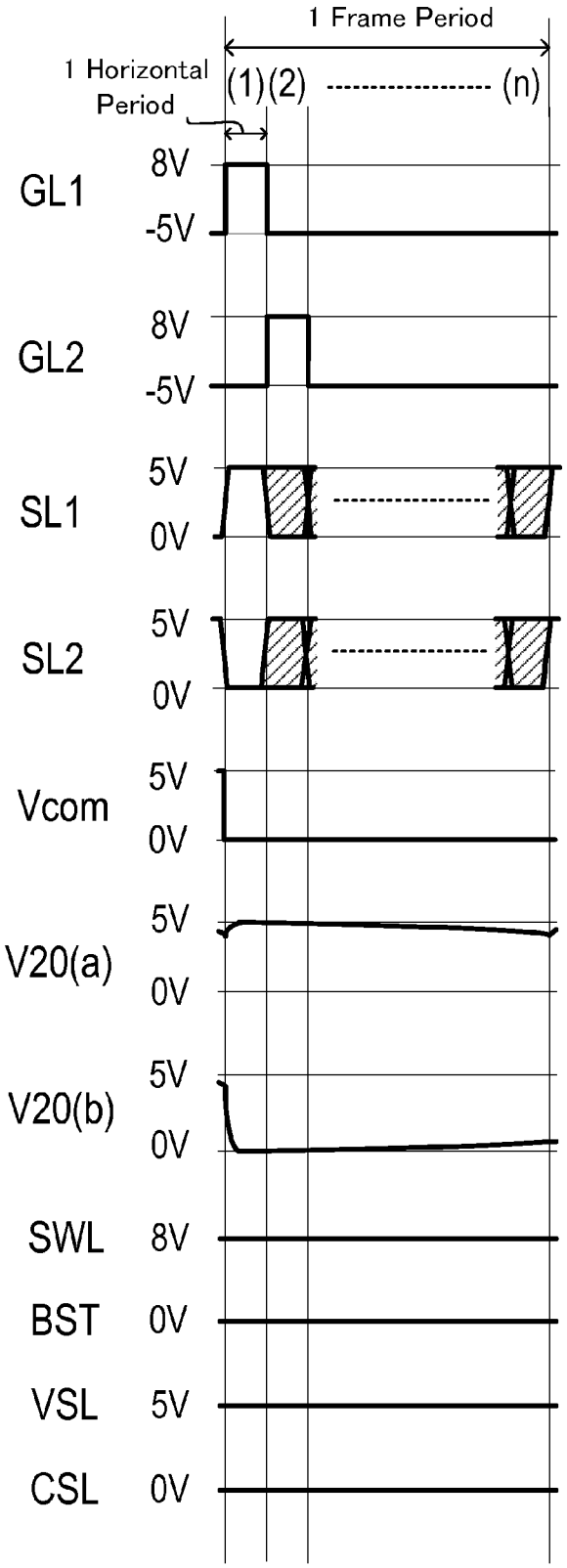
FIG. 7 is a timing chart of a writing action in a constant display mode in the pixel circuit of the present invention.

FIG. 7 shows a timing chart of the writing action in the constant display mode when the first type pixel circuit is used. FIG. 7 shows voltage waveforms of the two gate lines GL1 and GL2, the two source lines SL1 and SL2, the first control line SWL, the second control line BST, the voltage supply line VSL, and the auxiliary capacity line CSL, and a voltage waveform of the opposite voltage Vcom for the one frame period. Note that FIG. 7 also shows voltage waveforms of the pixel voltages V20 of the internal nodes N1 of the two pixel circuits 2. One of the two pixel circuits 2 is the pixel circuit 2(*a*) selected by the gate line GL1 and the source line SL1, and the other is the pixel circuit 2(*b*) selected by the gate line GL1 and the source line SL2, and (a) and (b) are allocated behind the pixel voltages V20 in the drawing to be distinguished.

The one frame period is divided into the horizontal periods whose number corresponds to the number of the gate lines GL, and the gate lines GL1 to GLn to be selected in the horizontal periods are sequentially allocated to them. FIG. 7 illustrates voltage changes of the two gate lines GL1 and GL2 in the first two horizontal periods. In the first horizontal period, the selected row voltage 8 V is applied to the gate line GL1, and unselected row voltage −5 V is applied to the gate line GL2, and in the second horizontal period, the selected row voltage 8 V is applied to the gate line GL2, and the unselected row voltage −5 V is applied to the gate line GL1. In the following horizontal periods, the unselected row voltage −5 V is applied to both of the gate lines GL1 and GL2. A multi-level hierarchical voltage (0 V to 5 V, periods except for the first horizontal period are displayed by cross-hatched patterns in the drawing) corresponding to the pixel data of the display line corresponding to each horizontal period is applied to the source line SL of each column (the two source lines SL1 and SL2 are representatively illustrated in FIG. 7). In addition, according to the example shown in FIG. 7, to describe the change of the pixel voltage V20, the voltages of the two source lines SL1 and SL2 for the first horizontal period are set to 5 V and 0 V, respectively for illustrative purposes.

In addition, as shown in FIG. 7, according to the writing action with which the voltage maintaining control action is not executed in parallel, each voltage applied to each of the first control line SWL, the second control line BST, the voltage supply line VSL, and the auxiliary capacity line CSL is constant throughout the one frame period, so that there is substantially no difference in the above signal line between the case where the wirings of the row are mutually connected and unified, and the case where the wirings of the row are independently provided. Therefore, FIG. 7 shows the voltage waveform in the former case for illustrative purposes.

In the pixel circuit 2, the first switch circuit 22 includes the series circuit of the transistor T1 and the transistor T2, so that the on/off of the first switch circuit 22 is controlled by the on/off of the transistor T1 and the transistor T2. More specifically, as described above, the selected row voltage 8 V is applied to the gate line GL of the selected row, and the unselected row voltage −5 V is applied to the gate line GL of the unselected row. Note that the reason why the negative voltage of −5 V is used as the unselected row voltage −5 V is to avoid the case where, in the off-state first switch circuit 22, the pixel voltage V20 could become a negative voltage due to the voltage change of the opposite voltage Vcom while the voltage of the liquid crystal voltage Vlc is maintained, so that the off-state first switch circuit 22 is unnecessarily turned on in this state.

In the writing action, the second switch circuit 23 needs to be turned off to prevent interference from the voltage supply line VSL. According to the second embodiment, since the second switch circuit 23 only includes the transistor T3, the transistor T3 is to be substantially turned off. When the second terminal and the control terminal of the transistor T3 have the same voltage, the second switch circuit 23 functions as a diode in a forward direction from the middle node N2 to the source line SL, so that a first control voltage (5 V in the second embodiment) which is not lower than a maximum voltage of the pixel data voltage (gradation voltage) held in the internal node N1 is applied to the voltage supply line VSL throughout the one frame period, to put the diode in a reversely biased state and turn off the second switch circuit 23.

A voltage of 8 V (first switch voltage) which is higher than the first control voltage (5 V) by the threshold voltage (about 2 V) or more is applied to the first control line SWL in order to put the transistor T4 into an always-on state for the one frame period regardless of the voltage state of the internal node N1. Thus, the output node N3 and the internal node N1 are electrically connected, and the output node N3 and the middle node N2 are at the same potential. As a result, as described above, the second switch circuit 23 is turned off. According to the second embodiment, when the high voltage 8 V is applied to the first control line SWL, the pixel data voltage (gradation voltage) transferred to the internal node N1 in the writing action for each pixel circuit 2 is sampled in the output node N3, as a preparation action to collectively execute the voltage maintaining control action for the pixel circuits 2 for the one frame after the writing action for the one frame period. Furthermore, when the output node N3 and the internal node N1 are electrically connected while the transistor T4 is in the always-on state, the first capacitive element C1 connected to the internal node N1 through the transistor T4 can be used to hold the pixel voltage V20, which contributes to stabilizing the pixel voltage V20. In addition, the second control line BST is fixed to a predetermined fixed voltage (such as 0 V: first boost voltage), and the auxiliary capacity line CSL is also fixed to a predetermined fixed voltage (such as 0 V). As for the opposite voltage Vcom, the above-described opposite AC driving is performed, but it is fixed to 0 V or 5 V for the one frame period. In FIG. 7, the opposite voltage Vcom is fixed to 0 V.

In addition, the predetermined fixed voltage (0 V in FIG. 7) is applied to the auxiliary capacity line CSL, but when the pixel circuit is the second type, the first control voltage (5 V) is applied to the voltage supply line CSL/VSL in which the voltage supply line VSL and the auxiliary capacity line CSL are combined. According to the second type pixel circuit, instead of applying the same voltage change as that of the opposite voltage Vcom to the voltage supply line CSL/VSL by the opposite AC driving with respect to each frame, when the first control voltage (5 V) is applied thereto, the opposite AC driving can be executed. In addition, in the second switch circuit 23 having the circuit configuration shown in FIG. 6, by connecting the transistor T3 in series to another transistor element which is turned off at the time of the writing action and turned on at the time of the voltage maintaining control action, the same voltage change as that of the opposite voltage Vcom can be applied to the voltage supply line CSL/VSL at the time of the opposite AC driving.

Third Embodiment

In the third embodiment, the voltage maintaining control action will be described with reference to the drawing. The voltage maintaining control action is executed in the constant display mode, in such a manner that for the plurality of the pixel circuits 2, the first switch circuits 22 are turned off, and the control circuits 24 are actuated in a predetermined sequence so that the voltage of the middle nodes N2 is maintained at the same voltage as that of the internal nodes N1 in order to suppress to a minimum a leak current of the off-state transistors T2 existing between the middle nodes N2 and the internal nodes N1 to control the on/off state of the transistors T3 in the second switch circuits 23. A leak current of the cutoff-state thin film transistor largely depends on a bias state between a source and a drain, and it can be the smallest when the voltage between the source and the drain is 0 V. Therefore, in the voltage maintaining control action, the bias state between the first terminal and the control terminal of the transistor T3 is controlled so that the middle node N2 becomes the same voltage or almost the same voltage as that of the internal node N1.

According to the third embodiment, the voltage maintaining control action is executed for all of the pixel circuits 2 for the one frame after the writing action, collectively at the same time. Therefore, the same voltage is applied at the same timing to all of the gate lines GL, the source lines SL, the first control lines SWL, the second control lines BST, the voltage supply lines VSL, and the auxiliary capacity lines CSL connected to the pixel circuits 2 serving as a target of the voltage maintaining control action, and the opposite electrode 30. The timing control of the voltage application is performed by the display control circuit 11 shown in FIG. 1, and individual voltage application is performed by each of the display control circuit 11, the opposite electrode drive circuit 12, the source driver 13, and the gate driver 14. The voltage maintaining control action is a specific action for the pixel circuit 2 in the present invention, and can considerably cut the power consumption, compared with the conventional similar leak current suppressing action in which the voltage of the middle node is driven by the unity gain buffer amplifier. Note that the "same time" in the above "collectively at the same time" means the "same time" having a time width of a sequence of the voltage maintaining control actions.

Figure 8:
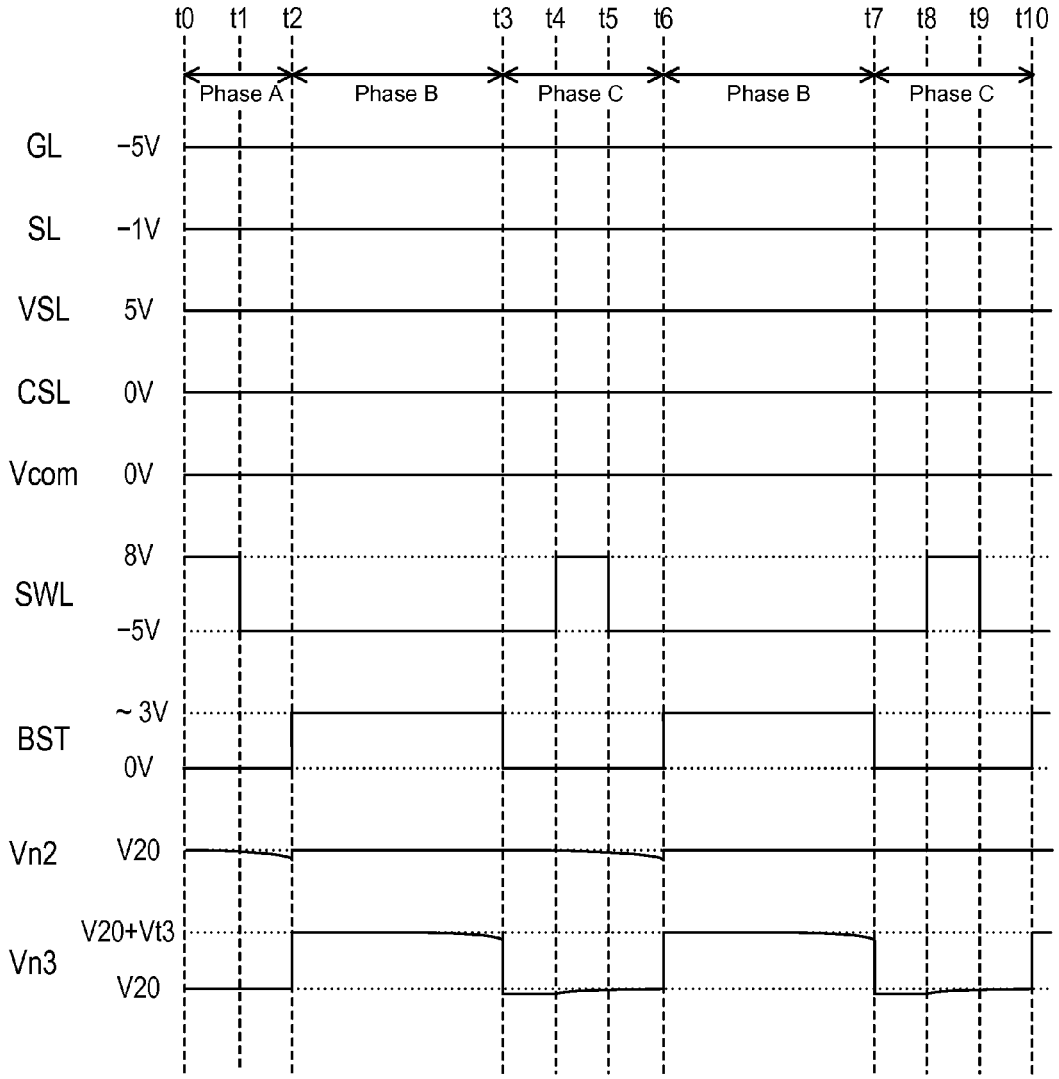
FIG. 8 is a basic timing chart of a voltage maintaining control action with respect to each frame in the pixel circuit of the present invention.

FIG. 8 shows a timing chart of the voltage maintaining control action for all of the pixel circuits 2 for the one frame in the case where the first type pixel circuit is used. As shown in FIG. 8, the voltage maintaining control action is divided into three basic phases (phases A to C). FIG. 8 shows voltage waveforms of all of the gate lines GL, the source lines SL, the first control lines SWL, the second control lines BST, the voltage supply lines VSL, and the auxiliary capacity lines CSL connected to the pixel circuits 2 which are the target of the voltage maintaining control action, and a voltage waveform of the opposite voltage Vcom. In addition, FIG. 8 shows voltage waveforms of a voltage Vn2 of the middle node N2 and a voltage Vn3 of the output node N3 on the assumption that the pixel voltage V20 of the internal node N1 is a high voltage gradation.

The voltages of the gate line GL, the source line SL, the voltage supply line VSL, and the auxiliary capacity line CSL, and the opposite voltage Vcom are maintained at respective predetermined voltages throughout the three basic phases (phases A to C). That is, a voltage of −5 V is applied to the gate line GL to turn off the first switch circuit 22 of the target pixel circuit 2. A first reset voltage (−1 V in the present embodiment) not higher than a minimum voltage (0 V in the present embodiment) of the pixel data voltage (gradation voltage) held in the internal node N1 is applied to the source line SL (the reason to apply the first reset voltage will be described below). The first control voltage (5 V in the present embodiment) not lower than the maximum voltage (5 V in the present embodiment) of the pixel data voltage (gradation voltage) held in the internal node N1 is applied to the voltage supply line VSL. As for the voltage supply line VSL, the same voltage as that in the previous writing action is continuously applied thereto. The auxiliary capacity line CSL is fixed to a predetermined fixed voltage (such as 0 V). The opposite voltage Vcom is fixed to 0 V or 5 V like at the time of the writing action (the opposite voltage Vcom is fixed to 0 V in FIG. 8). Note that while the predetermined fixed voltage (0 V in FIG. 8) is applied to the auxiliary capacity line CSL, the first control voltage (5 V) is applied to the voltage supply line CSL/VSL in which the voltage supply line VSL and the auxiliary capacity line CSL are combined, in the case where the pixel circuit is the second type.

In the phase A (t0 to t2), for a predetermined period from a time t0 (t0 to t1) just after the completion of the writing action, the first switch voltage (8 V) which turns on the transistor T4 regardless of the voltage state of the internal node N1 is applied from the first control line SWL to the control terminal of the transistor T4, to electrically connect the output node N3 and the internal node N1 to sample the pixel voltage V20 of the internal node N1 in the output node N3, and then at a time t1, the voltage of the first control line SWL is changed from the first switch voltage (8 V) to a second switch voltage (−5 V) to turn off the transistor T4 and electrically separate the output node N3 and the internal node N1, so that the pixel voltage V20 of the internal node N1 is held in the output node N3. The holding state continues until a time t2 when the phase B starts. Note that, as described above, since the pixel voltage V20 of the internal node N1 is sampled in the output node N3 at the time of the writing action, the sampling period from the times t0 to t1 can be omitted. In addition, in the holding period from the times t1 to t2, the transistor T4 only has to be turned off, so that the period can be set to a short time based on responsive characteristics of the transistor T4. In addition, the second control line BST is fixed to the first boost voltage (such as 0 V) set at the time of the writing action, for the period of the phase A.

It is to be noted that the voltage Vn3 (t1) held in the output node N3 for the holding period fluctuate as shown in the following formula 2, due to capacitive coupling of parasitic capacity Ct4g between the control terminal and the second terminal of the transistor T4 occurring due to the voltage change of the first control line SWL from the first switch voltage (8 V) to the second switch voltage (−5 V).

$$Vn3(t1)=V20-\Delta Vswl\cdot Ct4g/(Cbst+Cn3) \quad \text{Formula 2}$$

In the formula 2, V20 represents the pixel voltage held in the internal node N1 and is equal to the voltage of the output node N3 at the time of the sampling, ΔVswl is a voltage difference (13 V) between the first switch voltage (8 V) and the second switch voltage (−5 V), Cbst represents electric capacity of the first capacitive element C1, Cn3 represents electric capacity provided by subtracting the electric capacity Cbst of the first capacitive element C1 from the electric capacity parasitic in the output node N3, and (Cbst+Cn3) represents entire electric capacity parasitic in the output node N3. When the parasitic capacity Ct4g is small (about several thousandth) enough to be negligible with respect to the entire electric capacity (Cbst+Cn3) parasitic in the output node N3, the voltage fluctuation amount shown in a second term on the right-hand side in the formula 2 is about several mV, which is negligible.

After the phase A (t0 to t2), in the phase B (t2 to t3), the boosting action is performed to change the voltage of the second control line BST from the first boost voltage to a second boost voltage (such as 3 V) at the time t2. By the boosting action, the voltage Vn3 of the output node N3 is boosted to the voltage Vn3 (t2) shown in the following formula 3 due to the capacitive coupling of the first capacitive element C1.

$$Vn3(t2)=Vn3(t1)+\Delta Vbst\cdot Cbst/(Cbst+Cn3) \quad \text{Formula 3}$$

$$Vn3(t2)=V20+Vt3 \quad \text{Formula 4}$$

Here, a boost voltage difference ΔVbst (=second boost voltage−first boost voltage) is to be properly set based on the capacitive coupling ratio [Cbst/(Cbst+Cn3)] so that the right-hand side of the formula 3 becomes equal to a voltage provided by adding a threshold voltage Vt3 of the transistor T3 to the pixel voltage V20 held in the internal node N1, that is, so that the voltage Vn3 (t2) of the formula 3 establishes the relationship expressed by the formula 4. Since the first term on the right-hand side of the formula 3 is given by the formula 2, a sum of the second term on the right-hand side of the formula 3 and the second term (negative value) on the right-hand side of the formula 2 is to be equal to the threshold voltage Vt3 of the transistor T3. As described above, when the second term on the right-hand side of the formula 2 is so small as to be negligible, the second term on the right-hand side of the formula 3 is to be the threshold voltage Vt3 of the transistor T3. By the boosting action, the voltage provided by adding the threshold voltage Vt3 of the transistor T3 to the pixel voltage V20 is applied to the control terminal of the transistor T3, so that a voltage provided by subtracting the threshold voltage Vt3 from the voltage Vn3 (t2) applied to the control terminal of the transistor T3, that is, the pixel voltage V20 held in the internal node N1 is supplied to the internal node N2 through the transistor T3. The voltage Vn2 (0) of the middle node N2 just after the writing action is the pixel voltage V20 which is the same as that of the internal node N1, but it could fluctuate from the original pixel voltage V20 due to the leak current through the transistor T1 generated due to the subsequent fluctuation of the voltage applied to the source line SL. Here, in the case where the voltage Vn2 (0) is reduced from the pixel voltage V20 due to the above fluctuation, it returns to the original pixel voltage V20 through the transistor T3 during the period of the phase B. Note that, since during the period of the phase B, the leak current of the transistor T1 is resupplied from the side of the transistor T3, the voltage Vn2 (t2) of the middle node N2 during the period of the phase B is maintained at the pixel voltage V20 or its vicinity, so that the leak current of the transistor T2 provided between the internal node N1 and the middle node N2 can be suppressed to a minimum. As a result, a large voltage fluctuation that causes a reduction in display quality can be suppressed in the voltage V20 of the internal node N1, and the voltage is stably maintained at the original pixel voltage V20 or its vicinity.

FIG. 8 schematically shows that the voltage Vn2 of the high voltage gradation of the middle node N2 is slightly reduced, but returns to the voltage V20 at the time of the writing action, by the boosting action.

During the period of the phase B, the voltage Vn3 (t2) of the output node N3 is held by the entire electric capacity (Cbst+Cn3) parasitic in the output node N3, but the voltage is reduced due to the leak current flowing from the output node N3 to the internal node N1 through the off-state transistor T4 over the course of the period of the phase B. When the voltage Vn3 (t2) of the output node N3 is reduced, the voltage Vn2 of the middle node N2 is also reduced due to the leak current of the transistor T1, so that the voltage applied to between the source and the drain of the transistor T2 is increased by an amount corresponding to the voltage reduction of the voltage Vn3 (t2), the leak current of the transistor T2 is slightly increased, and the voltage of the pixel voltage V20 held in the internal node N1 is reduced. As a result, the voltage of the pixel voltage V20 is reduced. Therefore, the boosting state of the phase B is stopped once within a time frame previously set so that the voltage Vn3 (t2) of the output node N3 is not reduced by 50 mV or more, for example, to refresh the voltage Vn3 of the output node N3. The refreshing action of the voltage Vn3 is implemented such that the phase C (t3 to t6) is executed after the completion of the phase B, and then the phase B is executed again.

In the phase C (t3 to t6), the sampling and holding actions, as in the case in the phase A, are sequentially executed. At a time t3, the voltage of the second control line BST is changed from the second boost voltage to the first boost voltage and returns to the state just before the boosting action, and then at a time t4, the voltage of the first control line SWL is changed from the second switch voltage (−5 V) to the first switch voltage (8 V) to cancel the holding state and turn on the transistor T4. Thus, at the time t3, the voltage Vn3 of the output node N3 is reduced by a boosted amount by the boosting action in the phase B, due to the capacitive coupling of the first capacitive element C1. During the period of the phase B, in the case where the voltage Vn3 (t2) of the output node N3 is slightly reduced due to the leak current of the transistor T4, the voltage Vn3 of the output node N3 is lower than the pixel voltage V20 just after the sampling action, but when the transistor T4 is turned on at the time t4, the pixel voltage V20 of the internal node N1 is newly sampled in the output node N3. Here, compared with the entire electric capacity of the output node N3, the entire electric capacity of the internal node N1 is considerably large, so that the reduction of the pixel voltage V20 due to the sampling action can be neglected. Then, at a time t5, the voltage of the first control line SWL is changed from the first switch voltage (8 V) to the second switch voltage (−5 V) to turn off the transistor T4 to electrically separate the output node N3 and the internal node N1, so that the pixel voltage V20 of the internal node N1 is held in the output node N3. The period between the times t3 and t4 can be set to be short because the voltage Vn3 of the output node N3 only has to be reduced to the pixel voltage V20. In addition, the sampling period between the times t4 and t5 can be set to be short because the amount of the voltage reduction of the output node N3 only has to be compensated. In addition, a holding period between times t5 and t6 can be set to be short according to the responsive characteristics of the transistor T4 because the transistor T4 only has to be turned off. At a time t6 when the phase C (t3 to t6) ends, the boosting action is performed to change the voltage of the second control line BST from the first boost voltage to the second boost voltage to execute the phase B (t6 to t7) again. The boosting action of the phase B has been described above, so that a duplicative description is omitted. Since then, the phase B and the phase C are repeatedly executed in rotation until the next writing action starts.

During the voltage maintaining control action in the phases A to C, −5 V is applied to the gate line GL to turn off the first switch circuit 22 of the pixel circuit 2 serving as the target of the action. This is similar to the case where in the conventional pixel circuit which does not have the first switch circuit 23 and the control circuit 24, when the refreshing frequency is reduced at the time of the constant display mode in order to reduce the power consumption of the liquid crystal display device, the same switch circuit is in the off state while the given pixel circuit is in the standby state until the next writing action starts. According to the present embodiment, the refreshing frequency at the time of the constant display mode can be further reduced without the reduction in display quality.

Furthermore, a description will be given why during the voltage maintaining control action of the phases A to C, the first reset voltage (−1V in the third embodiment) which is not higher than the minimum voltage of the pixel data voltage (gradation voltage) held in the internal node N1 is applied to the source line SL.

Assuming that, during the voltage maintaining control action, the voltage higher than the minimum voltage of the pixel data voltage (gradation voltage) is applied to the source line SL, the pixel voltage V20 which is lower than the voltage of the source line SL could be held in the internal node N1 of the pixel circuit 2 connected to that source line SL. In this case, just after the writing action, the voltage of the middle node N2 is equal to the pixel voltage V20, and the leak current of the transistor T1 flows from the source line SL toward the middle node N2, so that the middle node N2 is supplied with currents from both of the transistor T1 and the transistor T3, which causes a voltage fluctuation in which its voltage rises from the pixel voltage V20 which is the same as that of the internal node N1 just after the writing action. Therefore, during the period of the phase B, by aligning the directions of the leak current of the transistor T1 and a current of the transistor T3 in the same direction to counterbalance them, the above voltage fluctuation can be suppressed, and the voltage Vn2 of the middle node N2 can be maintained at the pixel voltage V20 or its vicinity which is the same as that of the internal node N1 just after the writing action. That is, when the first reset voltage is applied to the source line SL, the above condition is satisfied.

Here, in the case where the first reset voltage applied to the source lines SL is the same, the higher the pixel data voltage (gradation voltage) held in the internal node N1 is, the higher the voltage of the middle node N2 is, so that the leak current of the transistor T1 increases. That is, even when the voltage Vn3 (t2) of the output node N3 during the period of the phase B is the sum of the pixel voltage V20 and the threshold voltage Vt3 of the transistor T3, the leak current of the transistor T1 differs depending on the gradation voltage, so that a little difference is generated in the voltage Vn2 maintained in the middle node N2. In the meantime, as described above, the gradation voltage is determined based on the transmittance characteristics of the liquid crystal layer 33 with respect to the liquid crystal voltage Vlc applied to between the pixel electrode 20 and the opposite electrode 30 of the unit liquid crystal display element LC, but the transmittance characteristics are not always linear, so that the voltage fluctuation of the middle gradation voltage appears as a large fluctuation of the transmittance of the liquid crystal. Therefore, it is preferable to adjust the boost voltage difference ΔVbst which is applied to the second control line BST so that the voltage Vn2 maintained in the middle node N2 becomes the same as the pixel voltage V20 maintained in the internal node N1, in the middle gradation voltage.

Fourth Embodiment

The description has been given of the case where the voltage maintaining control action performed for the all of the pixel circuits 2 for the one frame after the writing action is constituted by the three basic phases (phases A to C) in the third embodiment. According to the writing action for the pixel circuits 2 for the one frame, as described in the second embodiment, the writing action is performed in the manner such that the pixel data for the one frame is divided with respect to each display line in the horizontal direction (row direction), and the pixel data voltage corresponding to the pixel data for the one display line is applied to the source line SL of the column. Thus, as for the pixel circuit 2 in the display line (row) after completing the writing action, the pixel data voltage which is applied to perform the writing action for another row is applied to the first terminal of the transistor T1 thereof until completion of the writing action for the one frame period. Assuming that, as for the pixel circuit in which the pixel data of the minimum voltage gradation has been written, the pixel data of the maximum voltage gradation is sequentially written in the other pixel circuits in the same column after that, the maximum gradation voltage and the minimum gradation voltage are applied to the first terminal and the second terminal (middle node N2), respectively, in the transistor T1 of the pixel circuit in which the pixel data of the minimum voltage gradation has been written, and a bias condition in which the leak current from the source line SL to the middle node N2 reaches a maximum is successively generated. Therefore, the voltage Vn2 of the middle node N2 could rise a little from the pixel voltage V20 just after the completion of the writing action due to the leak current of the transistor T1. The electric capacity of the internal node N1 is considerably larger than the electric capacity parasitic in the middle node N2, so that the voltage fluctuation of the voltage Vn2 of the middle node 2 does not appear immediately as the voltage fluctuation of the internal node N1, but it is not preferable to leave that state as it is.

The voltage fluctuation in which the voltage Vn2 of the middle node N2 rises a little can be cleared, as described in the above third embodiment, by applying the first reset voltage (−1 V in the third embodiment) not higher than the minimum voltage of the pixel data voltage (gradation voltage) held in the internal node N1, to all of the source lines SL after the completion of the writing action for the one frame, but in order to clear the voltage rise of the middle node N2 in a more positive manner, it is also preferable to execute a resetting action to reset the voltages of the middle nodes N2 of all of the pixel circuits 2 to the minimum voltage of the pixel data voltage (gradation voltage) through the second switch circuits 23 at least one time before the start of the boosting action of the first, second, or later phase B of the voltage maintaining control action described in the third embodiment. Note that, once the voltage maintaining control action starts, the first reset voltage is applied to all of the source lines SL, so that the resetting action is preferably executed before the start of the boosting action of the first phase B. In addition, when the resetting action is executed, a set value of the first reset voltage may be set to a little higher (such as 0 V) than that in the case where the resetting action is not executed.

Figure 9:
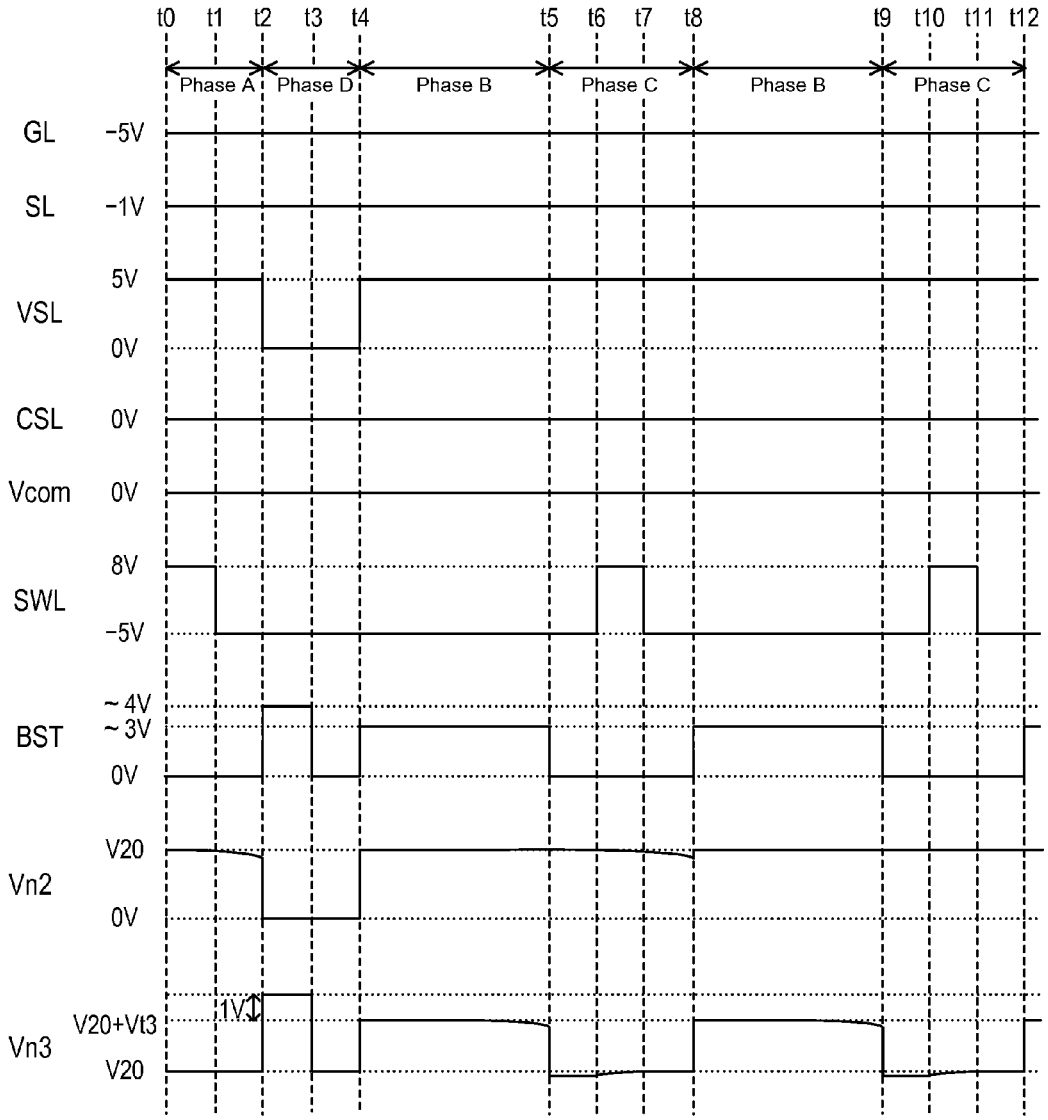
FIG. 9 is another timing chart of the voltage maintaining control action with respect to each frame in the pixel circuit of the present invention.

FIG. 9 shows a timing chart in the case where the resetting action for the middle node N2 as a phase D is inserted before the start of the boosting action of the first phase B, in the voltage maintaining control action for all of the target pixel circuits 2 for the one frame using the first type pixel circuits. As shown in FIG. 9, the phase D is added to the three basic phases (phases A to C) in the voltage maintaining control action, and the phases A, D, B, C, B, C, . . . are executed in this order. FIG. 9 shows, as with FIG. 8, voltage waveforms of all of the gate lines GL, the source lines SL, the first control lines SWL, the second control lines BST, the voltage supply lines VSL, and the auxiliary capacity lines CSL connected to the pixel circuits 2 as the target of the voltage maintaining control action, and a voltage waveform of the opposite voltage Vcom. In addition, FIG. 9 shows voltage waveforms of the voltage Vn2 of the middle node N2 and the voltage Vn3 of the output node N3 on the assumption that the pixel voltage V20 of the internal node N1 is the high voltage gradation.

As in the case in the third embodiment, the voltages of the gate line GL, the source line SL, the auxiliary capacity line CSL, and the opposite voltage Vcom are maintained at the respective fixed voltages throughout the three basic phases (phases A to C). Each voltage application condition is the same as that of the third embodiment, so that a duplicative description is omitted. The voltage of the voltage supply line VSL is maintained at the first control voltage (5 V in this fourth embodiment) throughout the three basic phases (phases A to C) as in the case in the third embodiment, but in the phase D, the second reset voltage (0 V in this fourth embodiment) which is the minimum voltage of the pixel data voltage (gradation voltage) held in the internal node N1 is applied thereto.

The phase A (t0 to t2) is the same as that in the third embodiment, so that a duplicative description is omitted.

After the phase A (t0 to t2), a boosting action to change the voltage of the second control line BST from the first boost voltage to a third boost voltage (such as about 4 V) is performed at a time t2 in the phase D (t2 to t4). By this boosting action, the voltage Vn3 of the output node N3 is boosted to the voltage Vn3 (t2) expressed by the following formula 5 due to capacitive coupling of the first capacitive element C1.

$$Vn3(t2)=Vn3(t1)+\Delta Vbst1\cdot Cbst/(Cbst+Cn3) \quad \text{Formula 5}$$

$$Vn3(t2)>Vt3 \quad \text{Formula 6}$$

Here, a boost voltage difference ΔVbst1 (=third boost voltage−first boost voltage) is to be properly set based on the capacitive coupling ratio [Cbst/(Cbst+Cn3)] so that the right-hand side of the formula 5 becomes higher (preferably more than 1 V higher) than the voltage provided by adding the threshold voltage Vt3 of the transistor T3 to the pixel voltage V20 (0 V in this fourth embodiment) of the minimum gradation voltage held in the internal node N1, that is, so that the voltage Vn3 (t2) of the formula 3 establishes the relationship expressed by the formula 6. The boost voltage difference ΔVbst1 used in the boosting action in the phase D is set to be higher than the boost voltage difference ΔVbst used in the boosting action in the phase B, such as by about 1 V higher than that.

Meanwhile, since the second reset voltage (0 V in this fourth embodiment) is applied to the voltage supply line VSL at the time t2, the transistor T3 is turned on, and the voltage Vn2 of the middle node N2 in each pixel circuit 2 is reset to 0 V regardless of the voltage state of the middle node N2 after the writing action. Then, at a time t3, the voltage of the second control line BST is changed from the third boost voltage to the first boost voltage and returns to the state before the resetting action, and then at a time t4, the first control voltage (5 V in this fourth embodiment) is applied to the voltage supply line VSL.

After the phase D (t2 to t4), at a time t4, the boosting action is performed to change the voltage of the second control line BST from the first boost voltage to the second boost voltage (such as about 3 V) (phase B: t4 to t5). The boosting action in the phase B (t4 to t5), and the sampling and holding actions in the phase C (t5 to t8) after the phase D are all the same as those in the third embodiment, and their duplicative descriptions are thus omitted. Note that the voltage transitions of the voltage supply line VSL and the second control line BST at the time t4 not necessarily occur at the same timing, and they may be made at slightly different timing from each other.

It is to be noted that, according to the resetting action in the phase D described in this fourth embodiment, since the second reset voltage is applied to the voltage supply line VSL under the condition that the predetermined fixed voltage is applied to the auxiliary capacity line CSL, the auxiliary capacity line CSL and the voltage supply line VSL have to be driven independently, so that the second type pixel circuit cannot be used.

Fifth Embodiment

According to the writing action and the voltage maintaining control action in the second and third embodiments, the descriptions have been given of the case where all of the pixel circuits 2 for the one frame are target of each of the actions, and after the writing action for the one frame, the voltage maintaining control action for the one frame is collectively performed at the same time. However, as described in the second embodiment, even when all of the pixel circuits 2 for the one frame are set as the target, the writing action is executed in a time-sharing manner such that the pixel data for one frame is divided with respect to each display line of the horizontal direction (row direction), and the pixel data voltage corresponding to each pixel data for the one display line is applied to the source line SL in each column with respect to each horizontal period. Therefore, a completion time of the writing action is substantially different in each display line of the row, so that there are variations in time width of the standby period from the completion of the writing action until the start of the voltage maintaining control action.

The pixel data voltage to perform the writing action for the subsequent row is applied to the source line SL during the standby period, so that the state in which the voltage different from the written pixel data voltage is applied to the first terminal of the transistor T1 in the already written row pixel circuit could continue throughout this standby period. According to the fifth embodiment, in order to correct the variations in time width in the standby period, the voltage maintaining control action starts independently just after the completion of the writing action in each row, with respect to each display line of the row. In order to control the voltage maintaining control action with respect to each row, timing has to be independently controlled for at least the first control line SWL and the second control line BST with respect to each row. Note that the resetting action for the middle node N2 described in the fourth embodiment can also be controlled with respect to each row, but the purpose thereof is to reset the voltage rise generated in the writing action for the one frame, so that it is preferable to collectively execute the resetting action for all of the pixel circuits 2 for the one frame after the writing action for the one frame. Therefore, the voltage supply line VSL is not necessarily controlled independently with respect to each row.

Figure 10:
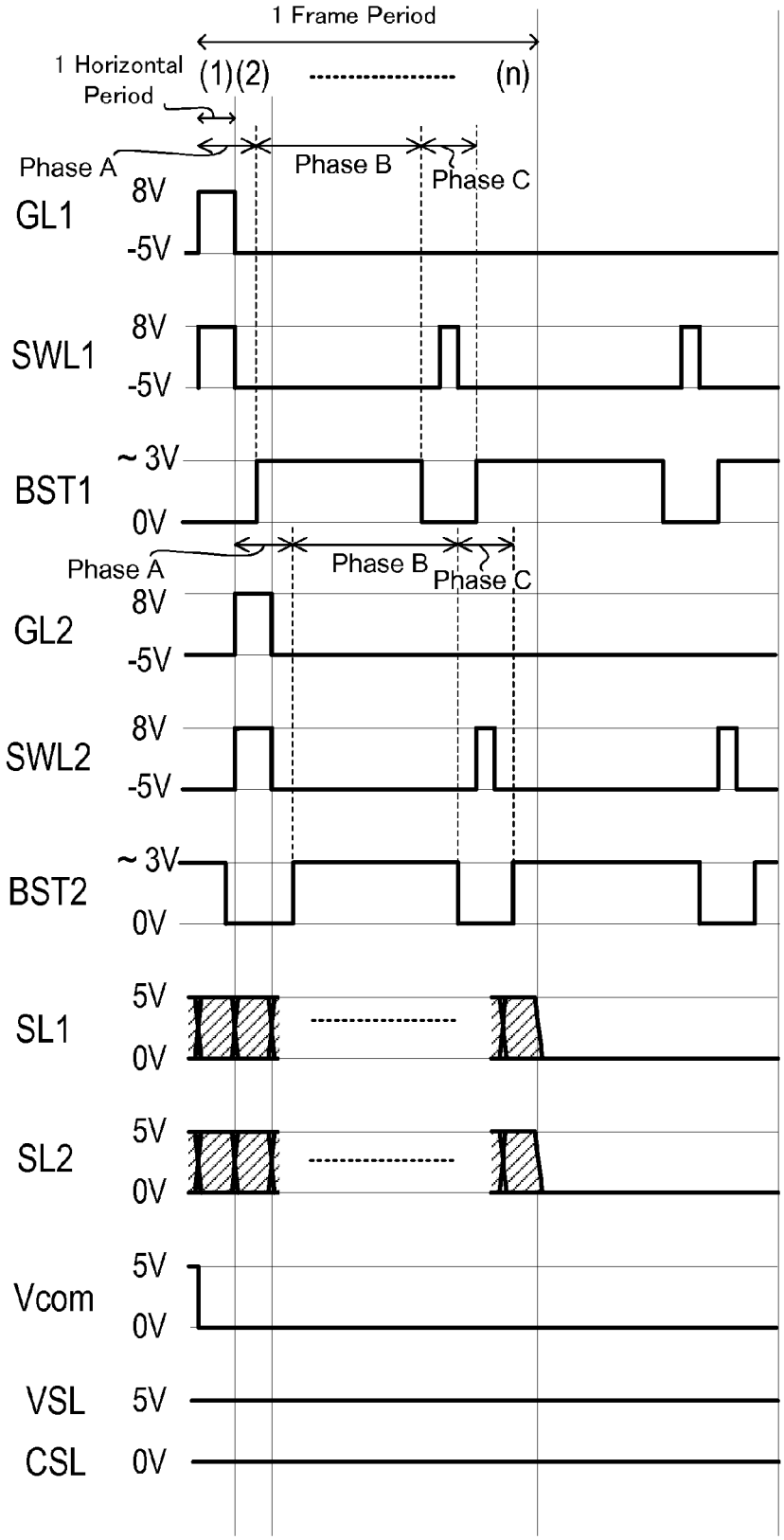
FIG. 10 is a timing chart of the writing action and the voltage maintaining control action with respect to each row in the pixel circuit of the present invention.

FIG. 10 shows a timing chart of the writing action and the voltage maintaining control action with respect to each row, in the constant display mode when the first type pixel circuit is used. FIG. 10 shows voltage waveforms of the two gate lines GL1 and GL2, the two source lines SL1 and SL2, two first control lines SWL1 and SWL2, two second control lines BST1 and BST2, the voltage supply line VSL, and the auxiliary capacity line CSL, and a voltage waveform of the opposite voltage Vcom for the one frame period. The gate line GL1, the first control line SWL1, and the second control line BST1 are connected to the pixel circuits 2 in the same row as the target of the writing action in the first horizontal period. In addition, the gate line GL2, the first control line SWL2, and the second control line BST2 are connected to the pixel circuits 2 in the same row as the target of the writing action in the second horizontal period. The first control line SWL1 and the second control line BST1 are used when the voltage maintaining control action is performed for the pixel circuits in the first row which were the target of the writing action in the first horizontal period after the second horizontal period, and the first control line SWL2 and the second control line BST2 are used when the voltage maintaining control action is performed for the pixel circuits in the second row which were the target of the writing action in the second horizontal period after the third horizontal period.

According to the writing action, the voltage application conditions of the first control line SWL and the second control line BST for the pixel circuits in the unselected row after the completion of the writing action are only different from the writing action described in the second embodiment, and the writing action for the selected row is totally the same as the writing action described in the second embodiment. In addition, the voltage application condition for the unselected row before the writing action is totally the same as the writing action described in the second embodiment.

According to the voltage maintaining control action performed during the writing action for the one frame, the pixel data voltage to be written in the pixel circuit serving as the writing action target is applied to the source line SL instead of the first reset voltage, which is different from the case in the voltage maintaining control action performed after the writing action, but the above voltage maintaining control actions are the same in that the three basic phases (phases A to C) described in the third embodiment are executed by the voltages applied to the first control line SWL and the second control line BST. Note that, after the writing action for the one frame, the first reset voltage is applied to each source line SL.

In addition, a predetermined fixed voltage (0 V in FIG. 10) is applied to the auxiliary capacity line CSL, but in the case where the pixel circuit is the second type, the first control line (5 V) is applied to the voltage supply line CSL/VSL in which the voltage supply line VSL and the auxiliary capacity line CSL are combined.

According to this fifth embodiment, the voltage maintaining control action is performed with respect to each row, but after the completion of the writing action for the one frame, the timing control of the first control line SWL and the second control line BST may be changed such that the voltage maintaining control action is collectively performed at the same time for the pixel circuits 2 for the one frame, as in the case of the voltage maintaining control action in the third embodiment. In addition, among the three basic phases, the repeating action of the phase B and the phase C after the first phase C or after the second phase B may be performed after the completion of the writing action for the one frame.

In addition, there is a case where as for the pixel circuit in the row which has not written yet during the writing action for the one frame shown in FIG. 10, the voltage maintaining control action executed after the previous writing action for the one frame still continues. In this case, it is also preferable to collectively control the voltage applied to the first control lines SWL and the second control lines BST in all of the unselected rows in which the writing action is not performed, during the writing action period for the one frame.

Sixth Embodiment

According to a sixth embodiment, a description will be given of the writing action in the normal display mode using the first type pixel circuit 2 shown in FIG. 4, with reference to the drawings.

According to the writing action in the normal display mode, pixel data for one frame is divided with respect to each display line in the horizontal direction (row direction), the multi-gradation analog voltage corresponding to each pixel data for the one display line is applied to the source line SL in each column with respect to each horizontal period, and a selected row voltage 8 V is applied to the gate line GL of the selected display line (selected row) to turn on the first switch circuit 22 of each pixel circuit 2 belonging to the selected row, and transfer the voltage of the source line SL in each column to the internal node N1 of each pixel circuit 2 in the selected row. An unselected row voltage −5 V is applied to the gate line GL (unselected row) except for the selected display line to turn off the first switch circuit 22 of each pixel circuit in the selected row. In addition, the timing control of the voltage applied to each signal line in the writing action as will be described below is performed by the display control circuit 11, and individual voltage application is performed by the display control circuit 11, the opposite electrode drive circuit 12, the source driver 13, and the gate driver 14 shown in FIG. 1.

Figure 11:
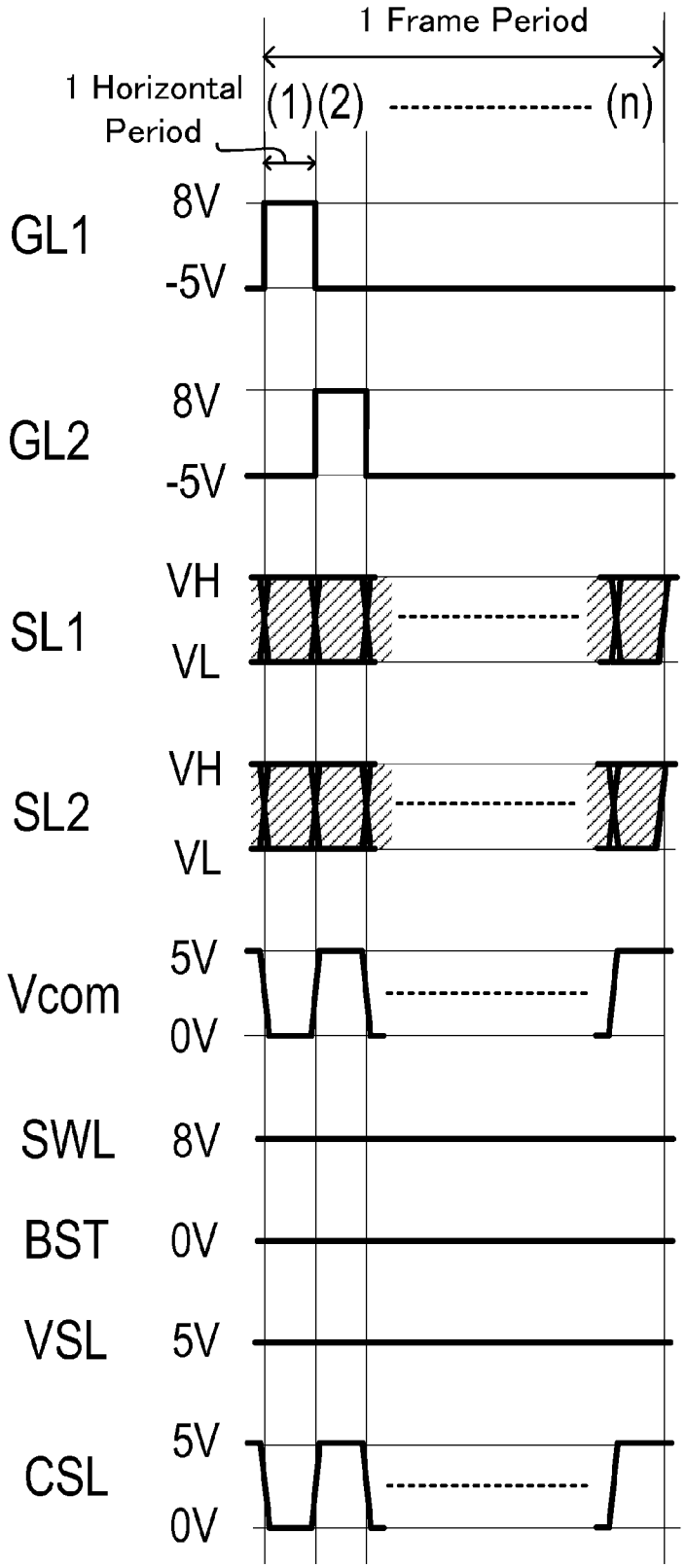
FIG. 11 is a timing chart of a writing action in a normal display mode in the pixel circuit of the present invention.

FIG. 11 shows a timing chart of the writing action in the normal display mode when the first type pixel circuit is used. FIG. 11 shows voltage waveforms of the two gate lines GL1 and GL2, the two source lines SL1 and SL2, the first control line SWL, the second control line BST, the voltage supply line VSL, and the auxiliary capacity line CSL, and a voltage waveform of the opposite voltage Vcom for the one frame period.

The one frame period is divided into the horizontal periods whose number corresponds to the number of the gate lines GL, and the gate lines GL1 to GLn to be selected in the horizontal periods are sequentially allocated to them. FIG. 11 illustrates voltage changes of the two gate lines GL1 and GL2 in the first two horizontal periods. In the first horizontal period, the selected row voltage 8 V is applied to the gate line GL1, and unselected row voltage −5 V is applied to the gate line GL2, and in the second horizontal period, the selected row voltage 8 V is applied to the gate line GL2, and the unselected row voltage −5 V is applied to the gate line GL1. In the following horizontal periods, the unselected row voltage −5 V is applied to both gate lines GL1 and GL2. A multi-level hierarchical analog voltage (the multi-gradation is displayed by cross-hatched patterns in the drawing) corresponding to the pixel data of the display line corresponding to each horizontal period is applied to the source line SL of each column (the two source lines SL1 and SL2 are representatively illustrated in FIG. 11). Note that, since the opposite voltage Vcom changes with respect to each horizontal period (opposite AC driving), the analog voltage has the voltage value corresponding to the opposite voltage Vcom in the same horizontal period. That is, the analog voltage applied to the source line SL is set such that the liquid crystal voltages Vlc given as the voltage difference between the opposite voltage Vcom and the pixel voltage V20 (V20−Vcom) have the same absolute value corresponding to the pixel data when the opposite voltages Vcom are 5 V and 0 V although their voltage polarities are different from each other.

The pixel circuit 2 includes the first switch circuit 22 constituted by the series circuit of the transistor T1 and the transistor T2, so that the on/off of the first switch circuit 22 is only controlled by the on/off of the transistor T1 and the transistor T2, as in the case in the writing action in the constant display mode. In addition, like the writing action in the constant display mode, the second switch circuit 23 needs to be turned off to prevent interference from the voltage supply line VSL, so that the first control voltage (5 V in the present embodiment) which is not lower than the maximum voltage of the pixel data voltage (gradation voltage) held in the internal node N1 is applied to the voltage supply line VSL throughout the one frame period.

A voltage of 8 V (first switch voltage) which is higher than the first control voltage (5 V) by the threshold voltage (about 2 V) is applied to the first control line SWL in order to put the transistor T4 in an always-on state for the one frame period regardless of the voltage state of the internal node N1. Thus, the output node N3 and the internal node N1 are electrically connected, and the output node N3 and the middle node N2 are at the same potential. As a result, the first capacitive element C1 connected to the internal node N1 through the transistor T4 can be used for holding the pixel voltage V20, which contributes to stabilization of the pixel voltage V20. In addition, the second control line BST is fixed to a predetermined fixed voltage (such as 0 V: first boost voltage).

As described above, since the opposite AC driving is performed for the opposite voltage Vcom with respect to each horizontal period, the auxiliary capacity line CSL is driven so as to reach the same voltage as that of the opposite voltage Vcom. This is because the pixel electrode 20 is capacitively coupled with the opposite electrode 30 through the liquid crystal layer, and it is also capacitively coupled with the auxiliary capacity line CSL through the auxiliary capacitive element C2, so that when the voltage of the auxiliary capacitive element C2 is fixed on the side of the auxiliary capacity line CSL, the change of the opposite electrode Vcom is divided between the auxiliary capacity line CSL and the auxiliary capacitive element C2, and appears in the pixel electrode 20, which causes the fluctuation of the liquid crystal voltage Vlc of the pixel circuit 2 in the unselected row. Therefore, when all of the auxiliary capacity lines CSL are driven so as to reach the same voltage as the opposite voltage Vcom, the voltages of the opposite electrode 30 and the pixel electrode 20 change in the same voltage direction, so that the liquid crystal voltage Vlc of the pixel circuit 2 in the unselected row can be prevented from fluctuating.

In addition, other than the above "opposite AC driving", a method for reversing the polarity of the display line with respect to each horizontal period, in the writing action in the normal display mode includes a method in which a predetermined fixed voltage is applied to the opposite electrode 30 as the opposite voltage Vcom. In this case, the voltage applied to the pixel electrode 20 alternately becomes a positive voltage and a negative voltage based on the opposite voltage Vcom with respect to each horizontal period. In this case, there is a method in which the pixel voltage is directly written through the source line SL, and a method in which after the voltage having a voltage range around the opposite voltage Vcom has been written, the voltage is adjusted so as to reach the positive voltage or the negative voltage based on the opposite voltage Vcom by the capacitive coupling of the auxiliary capacitive element C2. In this case, the auxiliary capacity line CSL is not driven to become the same voltage as the opposite voltage Vcom, but driven by pulses separately with respect to each row.

In addition, according to this sixth embodiment, the method in which the polarity of the display line is reversed with respect to each horizontal period is adopted in the writing action in the normal display mode to eliminate inconvenience generated when the polarity of the display line is reversed with respect to each frame as will be descried below. Note that, the method for eliminating that inconvenience includes a method in which the polarity is reversed with respect to each column, and a method in which the polarity is reversed with respect to each pixel in the row and column directions at the same time.

An assumption is made about a case where the positive liquid crystal voltage Vlc is applied to all of the pixels in a certain frame F1, and the negative liquid crystal voltage Vlc is applied to all of the pixels in the next frame F2. Even when the voltage having the same absolute value is applied to the liquid crystal layer, a fine difference is generated in transmittance of light depending on whether the polarity is positive or negative in some cases. When a high-quality still image is displayed, this fine difference could generate a slight change in a display manner between the frame F1 and the frame F2. In addition, even when a moving image is displayed, a fine difference could be generated in a display manner, in display regions in which the same contents are to be displayed between the frames. When the high-quality still image or the moving image is displayed, it is considered that such a fine difference could be visually recognized.

Thus, the normal display mode is a display mode in which such high-quality still image or the moving image is displayed, so that there is a possibility that the above fine difference is visually recognized. In order to avoid the above phenomenon, the polarity is reversed with respect to each display line in the same frame in the present embodiment. Thus, since the liquid crystal voltages Vlc having the different polarities between the display lines are applied even in the same frame, an effect on display image data based on the polarity of the liquid crystal voltage Vlc can be suppressed.

According to the writing action in the normal display mode, as shown in FIG. 11, the voltage supply line VSL and the auxiliary capacity line CSL are separately controlled for the opposite AC driving to reverse the polarity with respect to each display line, so that it cannot be applied to the second type pixel circuit shown in FIG. 6. However, by connecting another transistor element which is turned off at the time of the writing action and turned on at the time of the voltage maintaining control action to the transistor T3 in series in the second switch circuit 23 having the circuit configuration shown in FIG. 6, the voltage change similar to the opposite voltage Vcom can be applied to the voltage supply line CSL/VSL.

Other Embodiments

Hereinafter, other embodiments will be described.

(1) According to the above embodiments, at the time of the writing action in the normal display mode or the constant display mode, the first switch voltage (8 V) is applied to the first control line SWL to equalize the potential between the output node N3 and the internal node N1, and the first control voltage (5 V) is applied to the voltage supply line VSL to turn off the second switch circuit 23, but when the second switch circuit 23 includes a series circuit constituted by the transistor T3 and another controlling transistor instead of only being constituted by the transistor T3, the second switch circuit 23 can be turned off at the time of the writing action by directly turning on/off the controlling transistor, so that it is not necessarily to apply the first switch voltage (8 V) to the first control line SWL and to apply the first control voltage (5 V) to the voltage supply line VSL.

(2) According to the third embodiment, the description has been given of the case where the voltage maintaining control action is performed for all of the pixel circuits with respect to each frame, and according to the fifth embodiment, the description has been given of the case where the voltage maintaining control action is performed for the pixel circuits in the same row with respect to each row, but as another embodiment, the one frame is divided into a plurality of row groups each including the certain number of rows, and the action may be executed with respect to each row group. For example, the one frame may be divided every four rows, the voltage maintaining control action may be collectively performed for the pixel circuits in the four rows at the same time every time the writing action for the four rows completes. In this case, the number of the signal lines related to the independent timing control can be reduced, and the control can be simplified.

(3) According to the above embodiments, the second switch circuit 23 and the control circuit 24 are provided in each pixel circuit 2 on the active matrix substrate 10. Meanwhile, in the case where two kinds of pixel parts such as a transmissive pixel part to perform a transmissive liquid crystal display, and a reflective pixel part to perform a reflective liquid crystal display are provided on the active matrix substrate 10, the second switch circuit 23 and the control circuit 24 may be provided only for the pixel circuit of the reflective pixel part, and the second switch circuit 23 and the control circuit 24 may not be provided for the pixel circuit of the transmissive display part. In this case, the image is displayed in the transmissive pixel part in the normal display mode, and the image is displayed in the reflective pixel part in the constant display mode. In this configuration, the number of elements formed on the whole of the active matrix substrate 10 can be reduced.

(4) The pixel circuit 2 includes the auxiliary capacitive element C2 in the above embodiments, but the auxiliary capacitive element C2 may not be included. In this case, the auxiliary capacity line CSL is not needed, so that the first type pixel circuit 2 and the second type pixel circuit 2 have the same circuit configuration.

Figure 12:
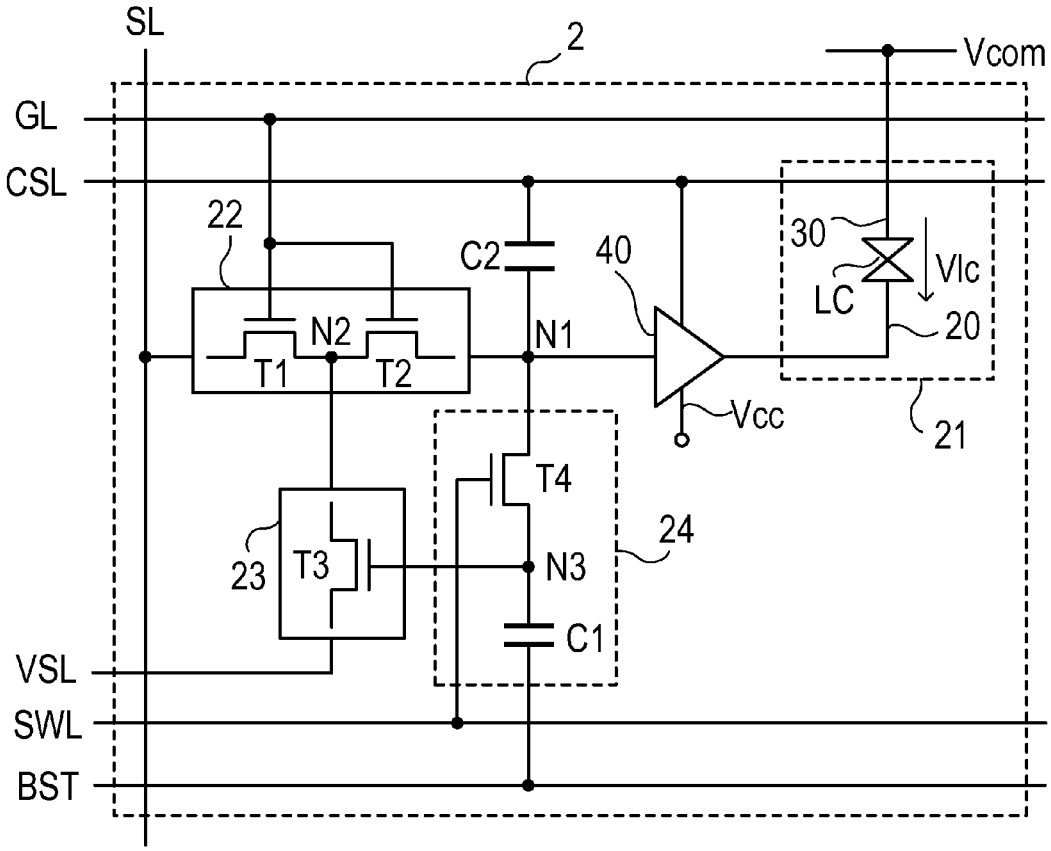
FIG. 12 is a circuit diagram showing another embodiment of the basic circuit configuration of the pixel circuit of the present invention.
Figure 13:
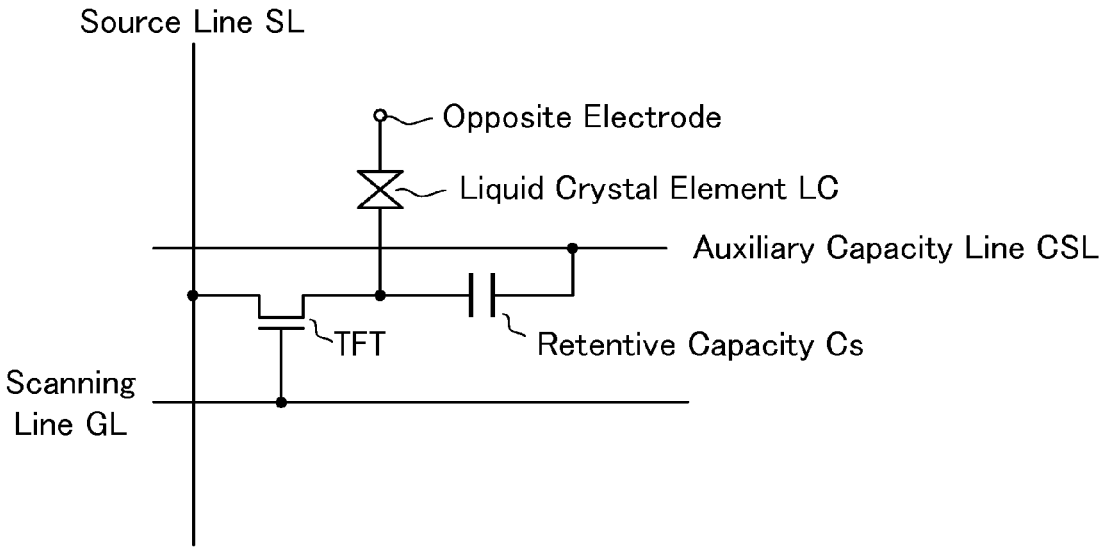
FIG. 13 is an equivalent circuit diagram of a pixel circuit of a typical active matrix type liquid crystal display device.
Figure 14:
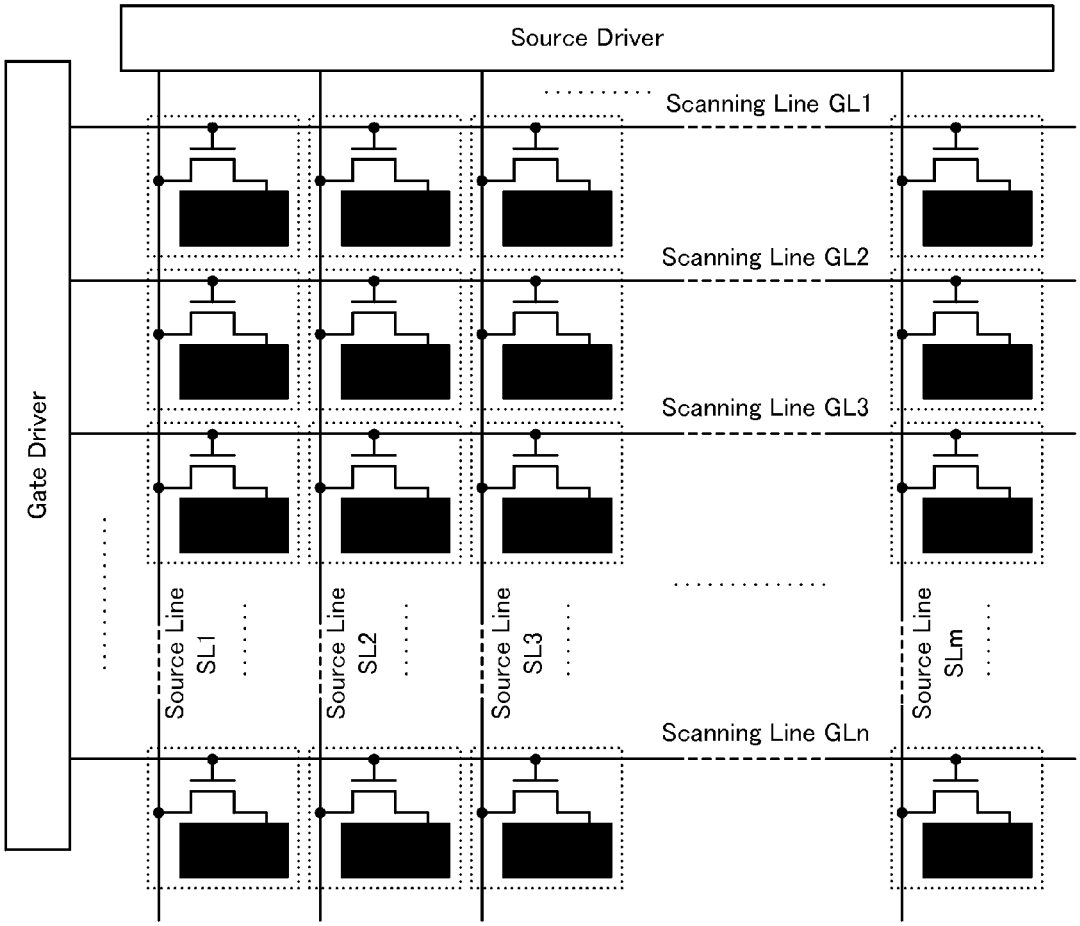
FIG. 14 is a block diagram showing a circuit arrangement example of an active matrix type liquid crystal display device having m×n pixels.
Figure 15:
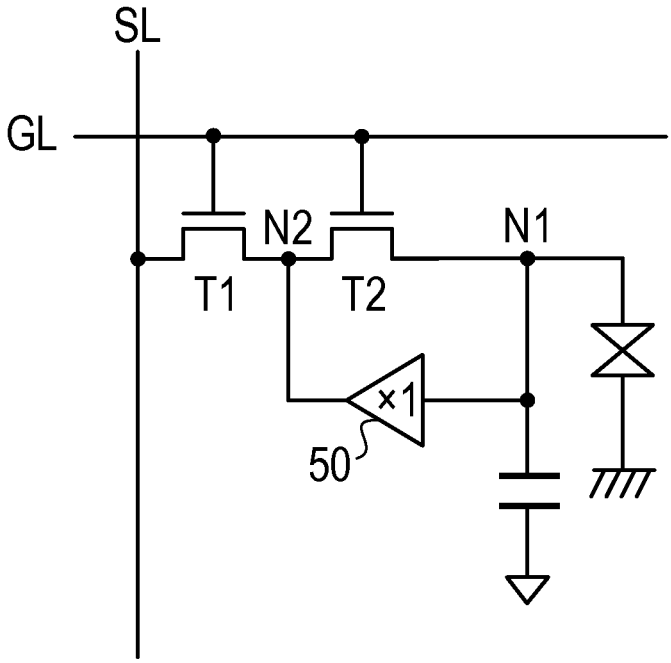
FIG. 15 is an equivalent circuit diagram showing one example of a conventional pixel circuit provided with a unity gain buffer amplifier.
Figure 16:
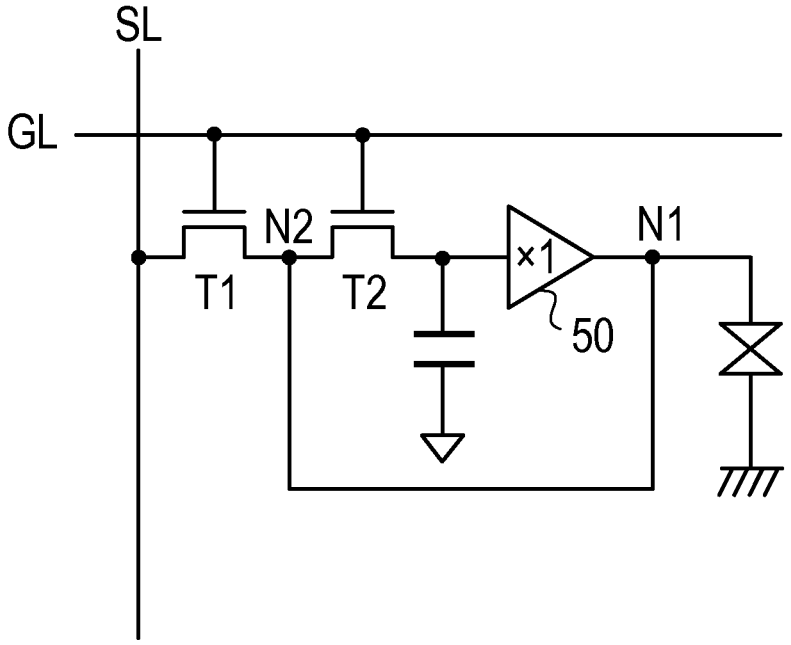
FIG. 16 is an equivalent circuit diagram showing another example of the conventional pixel circuit provided with the unity gain buffer amplifier.

(5) It is assumed that the display element part 21 of the pixel circuit 2 only includes the unit liquid crystal display element LC in the above embodiments, but as shown in FIG. 12, an analog amplifier 40 (voltage amplifier) may be provided between the internal node N1 and the pixel electrode 20. In FIG. 12, as one example, the auxiliary capacity line CSL and a power supply line Vcc are inputted as a power supply line of the analog amplifier 40.

In this case, the voltage applied to the internal node N1 is amplified at an amplification factor $\eta$ set by the analog amplifier 40, and the amplified voltage is supplied to the pixel electrode 20. Thus, a fine voltage change of the internal node N1 can be reflected on the display image.

(6) The N channel type polycrystalline silicon TFT are assumed as the transistors T1 to T4 in the pixel circuit 2 in the above embodiments, but a P channel type TFT may be used, or amorphous silicon TFT may be used. Also in the display device in which the P channel type TFT is used, the pixel circuit 2 can be operated in the same manner as the above embodiments and the same effect can be obtained by reversing positive and negative values of the power supply voltage and the voltage shown as the above-described action condition.

(7) According to the above embodiments, as the voltage values of the pixel voltage V20 and the opposite voltage Vcom in the constant display mode, 0 V and 5 V are assumed, and accordingly the voltage values applied to the signal lines are set to −5 V, 0 V, 5 V, and 8 V, but these voltage values can be appropriately changed according to the characteristics (such as threshold voltage) of the liquid crystal element and the transistor element to be used.

EXPLANATION OF REFERENCES

1: Display device
2: Pixel circuit
10: Active matrix substrate
11: Display control circuit
12: Opposite electrode drive circuit
13: Source driver
14: Gate driver
20: Pixel electrode
21: Display element part
22: First switch circuit
23: Second switch circuit
24: Control circuit
30: Opposite electrode
31: Opposite substrate
32: Sealing material
33: Liquid crystal layer
40: Analog amplifier
BST: Second control line
C1: First capacitive element
C2: Auxiliary capacitive element
CML: Opposite electrode wiring
CSL: Auxiliary capacity line
CSL/VSL: voltage supply line
Ct: Timing signal
DA: Digital image signal
Dv: Data signal
GL (GL1, GL2, . . . , GLn): Gate line
Gtc: Scanning side timing control signal
LC: Unit liquid crystal display element
N1: Internal node
N2: Middle node
N3: Output node
SWL: First control line
Sec: Opposite voltage control signal
SL (SL1, SL2, . . . , SLm): Source line
Stc: Data side timing control signal
T1, T2, T3, T4: Transistor
V20: Pixel voltage Vcom: Opposite voltage
Vlc: Liquid crystal voltage
VSL: Voltage supply line

The invention claimed is:

1. A pixel circuit comprising:

a display element part including a unit liquid crystal display element;

an internal node constituting a part of the display element part, and holding a pixel data voltage applied to the display element part;

a first switch circuit including a series circuit of a first transistor element and a second transistor element, having one end connected to a data signal line and another end connected to the internal node, and transferring the pixel data voltage supplied from the data signal line to the internal node through the series circuit;

a second switch circuit including a third transistor element, and having one end connected to a predetermined voltage supply line and another end connected to a middle node serving as a connection point between the first and second transistor elements connected in series in the series circuit; and a control circuit including a series circuit of a fourth transistor element and a first capacitive element, holding the pixel data voltage held in the internal node at one end of the first capacitive element through the fourth transistor element, and controlling an on/off state of the third transistor element in the second switch circuit by a boost voltage applied to the other end of the first capacitive element, wherein each of the first to fourth transistor elements comprises a first terminal, a second terminal, and a control terminal controlling a connection between the first and second terminals, the control terminals of the first and second transistor elements are connected to a scanning signal line to turn on the first and second transistor elements at a time of an action to transfer the pixel data voltage to the internal node, the control terminal of the third transistor element, the second terminal of the fourth transistor element, and the one end of the first capacitive element are mutually connected to constitute an output node of the control circuit, the first terminal of the fourth transistor element is connected to the internal node, the control terminal of the fourth transistor element is connected to a first control line, and the other end of the first capacitive element is connected to a second control line for supplying the boost voltage.

2. The pixel circuit according to claim 1, wherein the first switch circuit consists of the series circuit of the first and second transistor elements, and the first terminal of the first transistor element is connected to the data signal line, the second terminal of the first transistor element and the first terminal of the second transistor element are connected to the middle node, and the second terminal of the second transistor element is connected to the internal node.

3. The pixel circuit according to claim 1, wherein the second switch circuit consists of the third transistor element, and the first terminal of the third transistor element is connected to the voltage supply line, and the second terminal of the third transistor element is connected to the middle node.

4. The pixel circuit according to claim 1, further comprising:

a second capacitive element having one end connected to the internal node and the other end connected to a third control line or the voltage supply line.

5. A display device comprising:

a pixel circuit array having a plurality of the pixel circuits according to claim 1 arranged in a row direction and in a column direction, respectively, the pixel circuit array being provided in such a manner that, the data signal line is provided for each of columns, the scanning signal line is provided for each of rows, the one ends of the first switch circuits in the pixel circuits arranged in the same column are connected to a common data signal line, the control terminals of the first and second transistor elements in the pixel circuits arranged in the same row are connected to a common scanning signal line, the one ends of the second switch circuits in the pixel circuits arranged in the same row or the same column are connected to a common voltage supply line, the control terminals of the fourth transistor elements in the pixel circuits arranged in the same row or the same column are connected to a common first control line, and the other ends of the first capacitive elements in the pixel circuits arranged in the same row or the same column are connected to a common second control line;

the display device comprising:

a data signal line drive circuit driving the data signal lines separately;

a scanning signal line drive circuit driving the scanning signal lines separately;

a voltage supply line drive circuit driving the voltage supply lines separately or commonly; and a control line drive circuit driving the first control lines separately or commonly and driving the second control lines separately or commonly.

6. The display device according to claim 5, wherein the one ends of the second switch circuits in the pixel circuits arranged in the same row are connected to the common voltage supply line;

the control terminals of the fourth transistor elements in the pixel circuits arranged in the same row are connected to the common first control line, and the other ends of the first capacitive elements in the pixel circuits arranged in the same row are connected to the common second control line.

7. The display device according to claim 5, wherein at a time of a writing action to write pixel data having two or more gradations in the pixel circuits arranged in one selected row separately, the scanning signal line drive circuit applies a predetermined selected row voltage to the scanning signal line of the selected row to turn on the first and second transistor elements arranged in the selected row to activate the first switch circuit, and applies a predetermined unselected row voltage to the scanning signal line of a row except for the selected row to turn off the first and second transistor elements arranged in the row except for the selected row to inactivate the first switch circuit, and the data signal line drive circuit applies a pixel data voltage corresponding to the pixel data to be written in the pixel circuit in each column in the selected row, to each of the data signal lines separately.

8. The display device according to claim 7, wherein at the time of the writing action, the voltage supply line drive circuit applies a first control voltage not lower than a maximum voltage of the pixel data voltage held in the internal node, to the voltage supply line connected to the pixel circuits arranged in the selected row, and the control line drive circuit applies a first switch voltage to the first control line connected to the pixel circuits arranged in the selected row, and applies a first boost voltage to the second control line connected to the pixel circuits arranged in the selected row.

9. The display device according to claim 8, wherein at the time of the writing action, the voltage supply line drive circuit applies the first control voltage to the voltage supply line connected to the pixel circuits arranged in the row except for the selected row, and the control line drive circuit applies the first switch voltage to the first control line connected to the pixel circuits arranged in the row except for the selected row, and applies the first boost voltage to the second control line connected to the pixel circuits arranged in the row except for the selected row.

10. The display device according to claim 8, wherein the first switch voltage is high enough to turn on the fourth transistor element and equalize potentials of the internal node and the output node.

11. The display device according to claim 5, wherein at a time of a voltage maintaining control action performed, after a writing action to write pixel data having two or more gradations in the pixel circuits arranged in one selected row separately is completed with respect to each row or all rows of the pixel circuit array, to maintain a voltage of the middle node of the pixel circuit in which the writing action is completed, at the pixel data voltage held in the internal node, the scanning signal line drive circuit applies the unselected row voltage to the scanning signal line of one or more control target rows in which the writing action is completed, to turn off the first and second transistor elements in the pixel circuits arranged in the control target row, the voltage supply line drive circuit applies a first control voltage not lower than a maximum voltage of the pixel data voltage held in the internal node, to the voltage supply line connected to the pixel circuits arranged in the control target row, and, under a condition that a first switch voltage is applied to the first control line connected to the pixel circuits arranged in the control target row to turn on the fourth transistor element, and the internal node and the output node are at the same potential, the control line drive circuit applies a second switch voltage thereto to turn off the fourth transistor element to electrically separate the internal node and the output node, changes a voltage of the second control line connected to the pixel circuits arranged in the control target row from a first boost voltage to a second boost voltage, and boosts a voltage of the output node to a second control voltage provided by adding a threshold voltage of the third transistor element to the pixel data voltage held in the internal node, using capacitive coupling through the first capacitive element.

12. The display device according to claim 11, wherein at the time of the voltage maintaining control action, the control line drive circuit repeats a series of actions including:

an action to change the voltage of the second control line connected to the pixel circuits arranged in the control target row from the first boost voltage to the second boost voltage, and after a lapse of a predetermined time, return the voltage of the second control line from the second boost voltage to the first boost voltage;

an action thereafter to return a voltage of the first control line connected to the pixel circuits arranged in the control target row from the second switch voltage to the first switch voltage to equalize the potentials of the internal node and the output node, and thereafter apply the second switch voltage to the first control line again to electrically separate the internal node and the output node; and an action to change the voltage of the second control line connected to the pixel circuits arranged in the control target row from the first boost voltage to the second boost voltage again.

13. The display device according to claim 11, wherein a first operation by the control line drive circuit to apply the first switch voltage to the first control line connected to the pixel circuits arranged in the control target row to equalize the potentials of the internal node and the output node is performed at the time of the writing action performed for the pixel circuits arranged in the control target row.

14. The display device according to claim 11, wherein in a case where the control terminals of the fourth transistor elements of the pixel circuits arranged in the same row are connected to the common first control line, and the other ends of the first capacitive elements of the pixel circuits arranged in the same row are connected to the common second control line, every time the writing action is completed with respect to each row of the pixel circuit array, the voltage maintaining control action is started for the pixel circuits in the control target row in which the writing action is completed without waiting for completion of the writing action for all of the rows.

15. The display device according to claim 11, wherein at the time of the voltage maintaining control action performed after the writing action for all of the rows of the pixel circuit array, a first reset voltage not higher than a minimum voltage of the pixel data voltage held in the internal node is applied to all of the data signal lines.

16. The display device according to claim 11, wherein the pixel circuit comprises a second capacitive element having one end connected to the internal node, and the other end connected to a third control line.

17. The display device according to claim 11, wherein the pixel circuit comprises a second capacitive element having one end connected to the internal node, and the other end connected to the voltage supply line.

18. The display device according to claim 11, wherein at the time of the voltage maintaining control action, at least one resetting action is performed in such a manner that the control line drive circuit applies the second switch voltage to the first control line connected to the pixel circuits arranged in the control target row to electrically separate the internal node and the output node, the voltage supply line drive circuit applies a second reset voltage not higher than a minimum voltage of the pixel data voltage held in the internal node, to the voltage supply line connected to the pixel circuits arranged in the control target row, and the control line drive circuit changes the voltage of the second control line connected to the pixel circuits arranged in the control target row from the first boost voltage to a third boost voltage, applies a third control voltage higher than the threshold voltage of the third transistor element to the output node by the capacitive coupling through the first capacitive element to turn on the second switch circuit, and resets the voltage state of the middle node to the second reset voltage.

* * * * *